US005109144A

United States Patent [19]

Kaigler

[11] Patent Number: 5,109,144

[45] Date of Patent: Apr. 28, 1992

[54] FLUID PRESSURE OPERATED SWITCH

[75] Inventor: William J. Kaigler, North Huntingdon, Pa.

[73] Assignee: Robertshaw Controls Company, Richmond, Va.

[21] Appl. No.: 479,957

[22] Filed: Feb. 14, 1990

[51] Int. Cl.[5] ..... H01H 35/24

[52] U.S. Cl. ..... 200/83 R; 200/83 WM; 200/835 A

[58] Field of Search ..... 200/81 R, 83 R, 83 S, 200/83 SA, 83 WM, 83 Z, 329

[56] References Cited

U.S. PATENT DOCUMENTS

| | | | |
|---|---|---|---|
| 3,579,284 | 5/1971 | Mason et al. | 200/83 WM |
| 4,081,637 | 3/1978 | Stearley et al. | 200/83 WM |
| 4,115,674 | 9/1978 | Budlane et al. | 200/329 |
| 4,150,268 | 4/1979 | Stearley et al. | 200/83 R |
| 4,206,780 | 6/1980 | Manecke et al. | 200/83 WM |
| 4,617,432 | 10/1986 | Hanssen et al. | 200/81 R |
| 4,696,204 | 9/1987 | Buckshaw et al. | 200/83 WM X |

*Primary Examiner*—J. R. Scott
*Attorney, Agent, or Firm*—Candor, Candor & Tassone

[57] ABSTRACT

A pressure operated switch construction, parts therefor and methods of making the same are provided, the pressure operated switch construction comprising a housing having an external surface and carrying an electrical switch unit and a diaphragm assembly therein, and a compression spring unit carried by the housing and being interconnected to the switch unit and the diaphragm assembly to control the operation thereof in relation to the compressive setting of the spring unit, the housing having a bracket member extending outwardly from the external surface thereof in a flange-like manner and having first structure for mounting a first movable actuator unit to the housing that is to be interconnected to the spring unit to select the desired compressive setting thereof, the switch construction comprising a bracket interconnected to a second structure of the bracket member, and a second movable actuator carried by the bracket and being interconnected to the spring unit to select the desired compressive setting thereof whereby the bracket is only used when the housing is to carry the second movable actuator unit and the bracket member is not to mount the first movable actuator unit to the housing.

28 Claims, 12 Drawing Sheets

FLUID PRESSURE OPERATED SWITCH

BACKGROUND OF THE INVENTION

1. Field of the Invention

This invention relates to a new pressure operated switch construction and to new parts for a pressure operated switch construction as well as to a new method of making such a pressure operated switch construction and new methods of making such parts for a pressure operated switch construction.

2. Prior Art Statement

It is known to provide a pressure operated switch construction comprising a housing means having an external surface means and carrying an electrical switch unit and a diaphragm assembly therein, and a compression spring means carried by the housing means and being interconnected to the switch unit and the diaphragm assembly to control the operation thereof in relation to the compressive setting of the spring means, the housing means o control the operation thereof in relation to the compressive setting of the spring means, the housing means having a bracket member extending outwardly from the external surface means thereof in a flange-like manner means for mounting a movable actuator means to the housing means that is to be interconnected to the spring means to select the desired compressive setting thereof. For example, see the Stearley et al, U.S. Pat. No. 4,081,637.

It is also known to provide a pressure operated switch construction comprising a housing means having an external surface means and carrying an electrical switch unit and a diaphragm assembly therein, and a compression spring means carried by the housing means and being interconnected to the switch unit and the diaphragm assembly to control the operation thereof in relation to the compressive setting of the spring means, the housing means having a first bracket member and a second bracket member respectively extending outwardly in a flange-like manner from the external surface means thereof in spaced apart relation and respectively having means for mounting a movable actuator means to the housing means that is to be interconnected to the spring means to select the desired compressive setting thereof. For example, see the aforementioned Stearley et al, U.S. Pat. No. 4,081,637.

SUMMARY OF THE INVENTION

It is one of the features of this invention to provide a new pressure operated switch construction that has a housing means that provides for mounting different types of movable actuator means thereto to select the desired compressive setting of the compression spring means thereof.

In particular, it was found according to the teachings of this invention that in order to minimize the part variations due to customer requirements, a universal mounting arrangement for the various movable actuators was needed.

Therefore, according to the teachings of this invention, a housing structure is provided that will allow the use of one housing body for a plurality of applications regardless of the mounting configuration. This was accomplished by uniquely forming the mounting structure of the housing means of the pressure operated switch construction to receive different movable actuator means.

For example, one embodiment of this invention provides a pressure operated switch construction comprising a housing means having an external surface means and carrying an electrical switch unit and a diaphragm assembly therein, and a compression spring means carried by the housing means and being interconnected to the switch unit and diaphragm assembly to control the operation thereof in relation to the compressive setting of the spring means, the housing means having a bracket member extending outwardly from the external surface means thereof in a flange-like manner and having first means for mounting a first movable actuator means to the housing means that is adapted to be interconnectrd to the spring means to select the desired compressive setting thereof, the switch construction comprising a bracket interconnected to a second means fo the bracket member, and a second movable actuator carried by the bracket and being interconnected to the spring means to select the desired compressive setting thereof whereby the bracket is only used with the housing means when the housing means is to carry the second movable actuator means and the bracke tmember is not to mount the first movable actuator means to the housing means.

It is another feature of this invention to provide a new pressure operated switch construction that has unique means for mounting a movable slide actuator means thereto for being interconnected to the spring means thereof to select the desired compressive setting thereof.

This feature is accomplished by forming the bracket for the slide actuator means with means to readily interconnect with at least one of the two bracket members that respectively extend outwardly from the external surface means of the housing means of the pressure operated switch construction in a flange-like manner.

For example, another embodiment of this invention comprises a pressure operated switch construction comprising a housing means having an external surface means and carrying an electrical switch unit and a diaphragm assembly therein, and a compression spring means carried by the housing means and being interconnected to the switch unit and the diaphragm assembly to control the operation thereof in relation to the compressive setting of the spring means, the housing means having a first bracket member and a second bracket member respectively extending outwardly in a flange-like manner from the external surface means thereof in spaced apart relation and respectively having having means for mounting a first movable actuator means to the housing means that is adapted to be interconnected to the spring means to select the desired compressive setting thereof, the switch construction comprising a bracket disposed between the bracket members and being interconnected to a second means of at least one of the bracket members, the bracket carrying a movable slide actuator means that is interconnected to the spring means to select the desired compressive setting thereof whereby the bracket is only used with the housing means when the housing means is to carry the movable slide actuator means and the bracket members are not to mount the first movable actuator means to the housing means.

It is another feature of this invention to provide a new pressure operated switch construction having a unique pushbutton actuator arrangement carried thereby.

In particular, it was found according to the teachings of this invention that the prior push-button arrangement for a pressure operated switch construction utilizes the largest number of parts and requires the highest level of assembly and is, therefore, very labor intensive and costly to assemble.

However, it was found according to the teachings of this invention that a unique bracket can be provided to be interconnected to a bracket member of the housing means of the pressure operated switch construction and carry push-button actuator means that are interconnected to the spring means thereof to select the desired compressive setting thereof.

For example, another embodiment of this invention provides a pressure operated switch construction comprising a housing means having an external surface means and carrying an electrical switch unit and a diaphragm assembly therein, and a compression spring means carried by the housing means and being interconnected to the the switch unit and the diaphragm assembly to control the operation thereof in relation to the compressive setting of the spring means, the housing means having a bracket member extending, outwardly from the external surface means thereof in a flange-like manner and having first means for mounting a first movable actuator means to the housing means that is to be interconnected to the spring means to select the desired compressive setting thereof, the switch construction comprising a bracket interconnected to a second means of the bracket member and push-button actuator means that is interconnected to the spring means to select the desired compressive setting thereof whereby the bracket is only used with the housing means when the housing means is to carry the push button actuator means and the bracket member is not to mount the first movable actuator means to the housing means.

It is another feature of this invention to provide a new pressure operated switch construction wherein the rotary actuator means therefor can have the longitudinal axis of the actuator shaft thereof disposed substantially at a right angle relative to the plane of the diaphragm assembly thereof.

In particular, it was found according to the teachings of this invention that prior known pressure operated switch constructions that have a rotary actuator means have the longitudinal axis of the rotary shaft disposed parallel to the plane of the diaphragm assembly so that the space required to position the switch construction behind a control panel of an appliance utilizing the same was dictated by the diaphragm diameter and, since the diaphragm diameter is also related to the performance of the pressure operated switch construction, there is a finite minimum space required.

However, it was found according to the teachings of this invention that a unique bracket can be provided for a pressure operated switch construction to permit the longitudinal axis of the rotatable shaft means thereof to be disposed substantially at a right angle to the diaphragm assembly to permit the diaphragm assembly to be mounted parallel to the control panel rather than perpendicular thereto as in the past.

For example, another embodiment of this invention comprises a pressure operated switch construction comprising a housing means having an external surface means and carrying an electrical switch unit and a diaphragm assembly therein, and a compression spring means carried by the housing means and being interconnected to the switch unit and the diaphragm assembly to control the operation thereof in relation to the compressive setting of the spring means, the housing means having a bracket member extending outwardly from the external surface means thereof in a flange-like manner and having first means for mounting a first movable actuator means to the housing neans that is to be interconnected to the spring means to select the desired compressive setting thereof, the switch construction comprising a bracket interconnected to a second member of the bracket member, and a second movable actuator means carried by the bracket and being operatively associated with the spring means to select the desired compressive setting thereof whereby the bracket is only used with theh ousing means when the housing means is to carry the second movable actuator means and the bracket memeber is not to mount the first movable actuator means to the housing means comprising a rotatable shaft means having a longitudinal axis that is disposed substantially at a right angle to the diaphragm assembly.

It is another feature of this invention to provide a new pressure operated switch construction having a unique switchblade structure that is self-piloting in its assembly with the housing means thereof so as to eliminate a costly riveting operation.

In particular, it was found according to the teachings of this invention that the prior known switch assembly for a pressure operated switch construction comprises three separate parts that require the same to be oriented properly during the assembly process in addition to requiring the use of a rivet to attach the blade assembly to the housing body while the blade parts are being oriented so that this prior known method is relatively costly and subject to errors.

However, it was found according to the teachings of this invention that the switchblade structure for the pressure operated switch construction can be uniquely formed so as to be a self-contained subassembly that assembles to the housing means in a self-piloting manner to its proper position in the housing means.

For example, another embodiment of this invention comprises a pressure operated switch construction comprising a housing means carrying an electrical switch unit and a diaphragm assembly therein, a compression spring means carried by the housing means and being interconnected to the switch unit and the diaphragm assembly to control the operation thereof in relation to the compressive setting of the spring means, and a movable actuator means carried by the housing means and being interconnected to the spring means to select the desired compressive setting thereof, the switch unit comprising a self-contained subassembly comprising a switchblade structure having a terminal secured thereto and a projection secured thereto in spaced relation to the terminal, the housing means having two slot means therein respectively receiving parts of the terminal and the projection therein to self-pilot the subassembly into its proper position in the housing means, the terminal and the projection being secured to the housing means to hold the subassembly in its proper position.

It is also another feature of this invention to provide new parts for pressure operated switch construction and the like as will be apparent hereinafter.

Accordingly, it is an object of this invention to provide a new pressure operated switch construction having one or more of the novel features of this invention as set forth above or hereinafter shown or described.

Another object of this invention is to provide a new method of making such a pressure operated switch construction, the method of this invention having one or more of the novel features of this invention as set forth above or hereinafter shown or described.

Another object of this invention is to provide a new part for a pressure operated switch construction, the new part of this invention having one or more of the novel features of this invention as set forth above or hereinafter shown or described.

Another object of this invention is to provide a new method of making such a new part, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
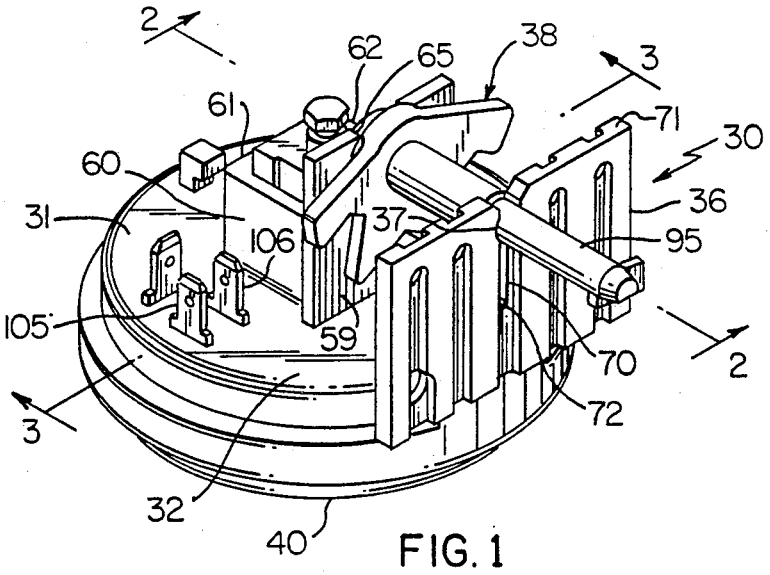
FIG. 1 is a perspective view of one of the new pressure operated switch constructions of this invention.

While the various features of this invention are hereinafter illustrated and described as being particularly adapted to provide a pressure operated switch construction for controlling the water level in a laundry machine, it is to be understood that the various features of this invention can be utilized singly or in various combinations thereof to provide a pressure operated switch construction for other apparatus as desired.

Therefore, this invention is not to be limited to only the embodiments illustrated in the drawings, because the drawings are merely utilized to illustrate one of the wide variety of uses of this invention.

Figure 2:
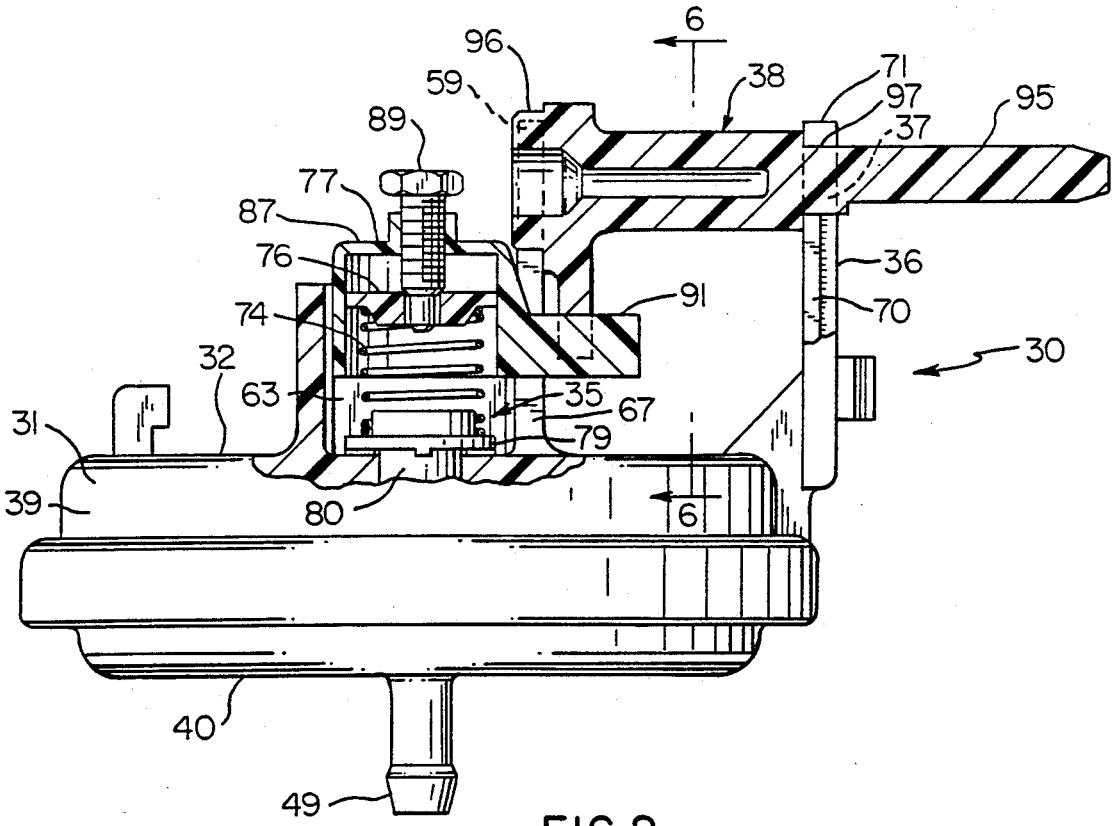
FIG. 2 is an enlarged side view of the pressure operated switch construction of FIG. 1 and is partially in cross-section as taken on lines 2—2 of FIG. 1.
Figure 3:
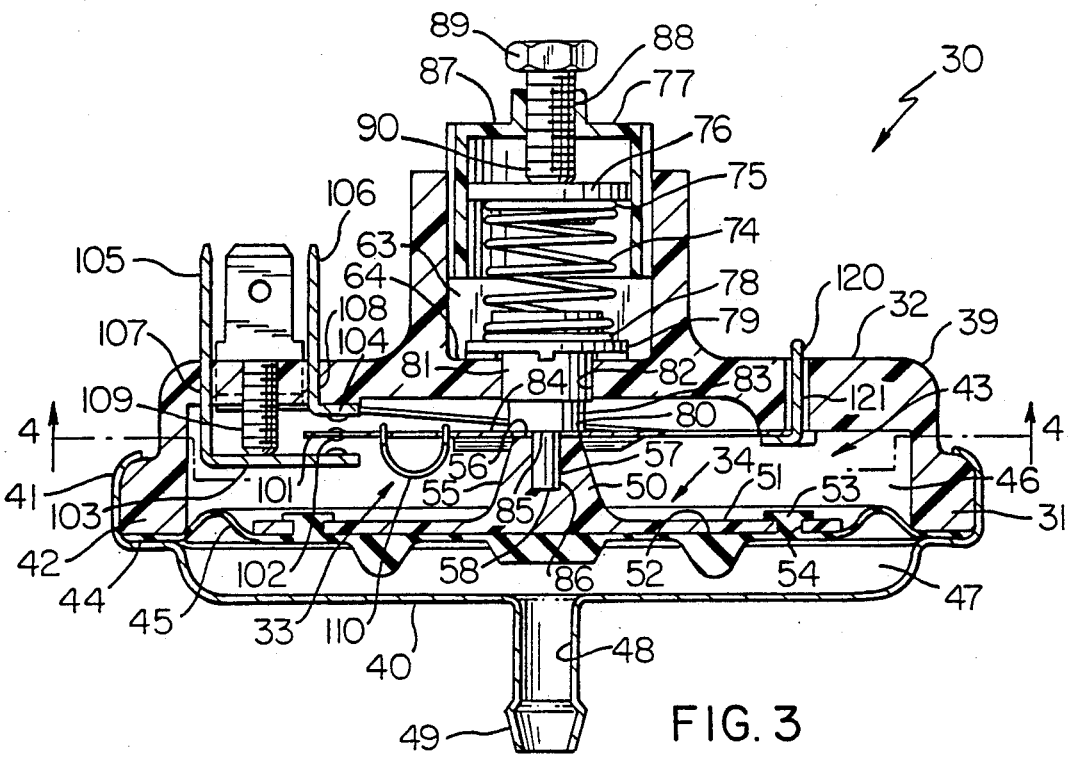
FIG. 3 is an enlarged cross-sectional view taken on line 3—3 of FIG. 1.

Referring now to FIGS. 1-9, a new pressure operated switch construction of this invention is generally indicated by the reference numeral 30 and comprises a housing means 31 having an external surface means 32 and carrying an electrical switch unit that is generally indicated by the reference numeral 33 in FIG. 3 and a diaphragm assembly that is generally indicated by the reference numeral 34 in FIG. 3 therein, and a compression spring means that is generally indicated by the reference numeral 35 in FIG. 3 carried by the housing means 31 and being interconnected to the switch unit 33 and the diaphragm assembly 34 to control the operation thereof in relation to the compressive setting of the spring means 35, the housing means 31 having a bracket member 36 extending putwardly from the external surface means 32 in a flange-like manner and having first means 37 for mounting a movable actuator means that is generally indicated the reference numeral 38 in FIG. 1 and is to be interconnected to the spring means 35 to select the desired compressive setting thereof. Such structure is generally set forth in the aforementioned Stearley et al, U.S. Pat. No. 4,081,637 whereby this patent is being incorporated into this disclosure by this reference thereto.

Since the general operation of a pressure operated switch construction for controlling the liquid level in a laundry machine is well known in the art as set forth in the aforementioned Stearley et al, U.S. Pat. No. 4,081,637 as well as set forth in the Rhodes et al, U.S. Pat. No. 3,249,712 which patent is also being incorporated into this disclosure by this reference thereto, only the details of the various pressure operated switch constructions of this invention need be set forth.

The housing means 31 of the pressure operated switch construction 30 is formed from a first cup-shaped housing member or body part 39 formed of any suitable material, such as plastic material, and another cup-shaped housing member 40 formed of any suitable material, such as metallic material, and having its open end 41 turned over and around part of an open end 42 of the housing member 39 to not only hold the housing members 39 and 40 together to define a chamber 43 within the housing means or body 31, but also to hold an outer peripheral portion 44 of a flexible diaphragm 45 of the diaphragm assembly 34 therebetween so that the diaphragm 45 divides the chamber 34 into two chamber sections 46 and 47 that are sealed from each other by the flexible diaphragm 45.

The chamber section 47 of the housing means 31 is adapted to be in communication with a fluid pressure directed thereto through a passage means 48 in a tubular extension 49 of the housing member 40 in a manner well known in the art whereby the position of the diaphragm 45 is controlled by the resulting pressure differential operating across the diaphragm 45 as the chamber section 46 is at atmospheric conditions since the chamber section 46 is not sealed from the exterior of the housing member 39 whereby the compression spring means 35 in cooperation with the pressure differential acting across the flexible diaphragm 45 determines the position of the diaphragm 45 and, thus, the operative condition of the electrical switch means 33 in a manner well known in the art.

While the flexible diaphragm 45 can be formed of any suitable polymeric material, such as rubber, a more rigid diaphragm backup member 50 has a disc-like portion 51 thereof disposed against the side 52 of the diaphragm 45 and is interconnected thereto in any suitable manner, such as by having rivet-like portions 53 of the diaphragm 45 respectively disposed through a circular array of openings 54 in the disc-like portion 51 of the backup member 50.

The diaphragm backup member 50 can be formed of any suitable material, and in the embodiment illustrated in the drawings, the backup member 50 is formed of a relatively rigid plastic material, and has a central projection 55 extending therefrom and terminating at a substantially flat end surface 56 which is interrupted by an opening 57 that defines an internal shoulder 58 in the central projection 55 for a purpose hereinafter set forth.

While the subject matter of the unique features of the compressive spring means 35 of the pressure operated switch construction 30 of this invention comprise the invention of William J. Kaigler et al as set forth in the copending patent application, Ser. No. 479,956, filed, Feb. 14, 1990, sufficient details of such unique spring means 35 to understand the features of this invention will now be set forth.

The housing member 39 has four interconnected substantially flat walls 59, 60, 61 and 62 extending outwardly therefrom and defining an opening 63 therebetween which has a substantially rectangular cross-sectional configuration and terminates at a substantially flat surface 64 at the bottom thereof as illustrated in FIG. 3, the wall 59 comprising another bracket member of the housing means 31 that is disposed in spaced parallel relation to the first bracket member 36 and also having first means 65 for cooperating with the first means 37 of the bracket member 36 to rotatably mount the actuator means 38 thereto in a manner hereinafter set forth.

It can be seen that the bracket members 36 and 59, as well as the walls 60–62 are a one-piece structure with the housing member 39 and can be formed during a molding operation of a plastic material to form the cup-shaped housing member 39.

Figure 5:
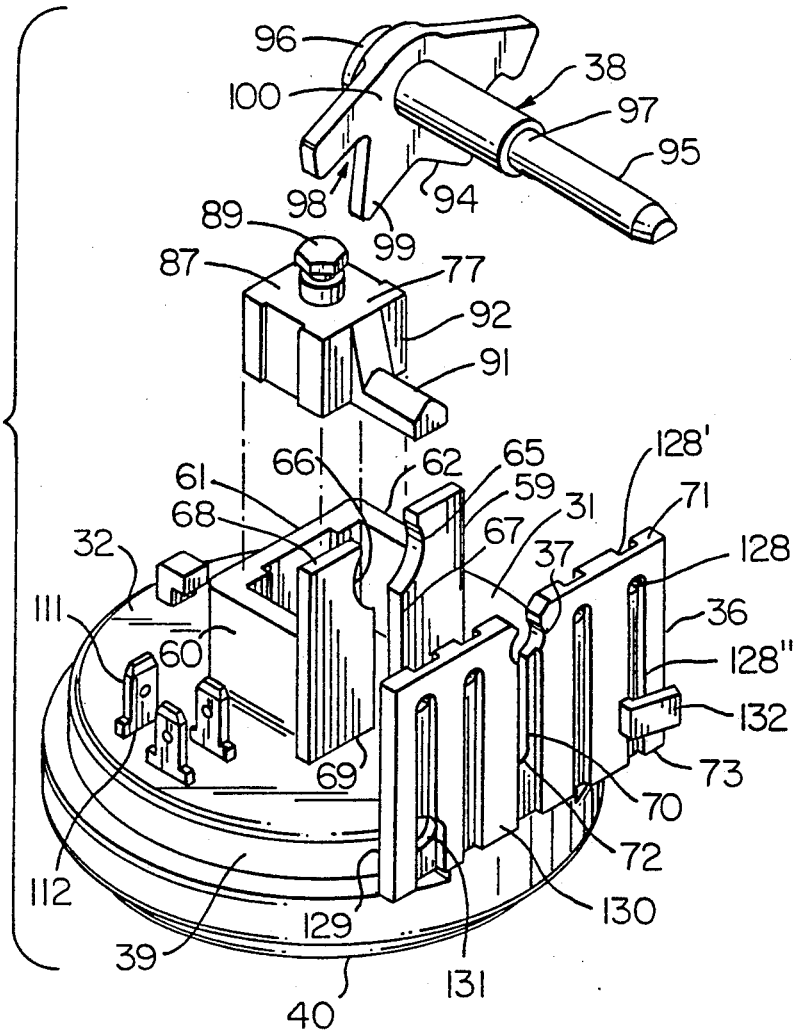
FIG. 5 is an an exploded perspective view of certain parts of the pressure operated switch construction of FIG. 1.
Figure 6:
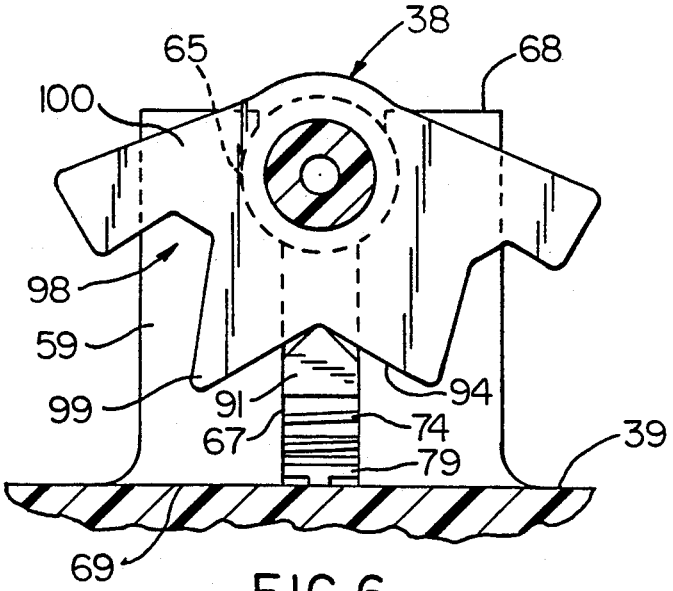
FIG. 6 is a fragmentary cross-sectional view taken on line 6—6 of FIG. 2.

The first means 65 of the wall or bracket member 59 comprises a substantially circular opening 66 formed therethrough and being bisected by a slot means 67 that extends from a top 68 of the wall.59 to a bottom 69 thereof as illustrated in FIG. 5, the first means 37 of the bracket member 36 likewise comprising a substantially circular opening passing through the bracket member 36 and being bisected by a slot means 70 that extends from a top 71 of the bracket member 36 to a point 72 intermediate the top 71 and a bottom 73 of the bracket member 36 as illustrated in FIG. 5 for a purpose hereinafter set forth.

A coiled compression spring 74 is disposed in the chamber 63 and has one end 75 bearing against a disc member 76 disposed in a spring actuator 77 that is disposed for sliding movement in the chamber 63 and has another end 78 bearing against a disc-like portion 79 of a spring retainer 80 that has a reduced cylindrical portion 81 passing through a circular opening 82 in the housing member 39 so that a further reduced cylindrical portion 83 thereof will trap a center blade 84 of the switch unit 33 between an end surface 85 of the portion 83 of the spring retainer 80 and the end surface 56 of the central projection 55 of the diaphragm assembly 34 while a further reduced portion 86 of the spring retainer 80 passes through the center blade 84 and is received in the opening 57 of the diaphragm assembly 34 as illustrated in FIG. 3.

In this manner, the compressive force of the spring means 74 maintains the center blade 84 of the switch unit or means 33 between the spring retainer 80 and the diaphragm assembly 34 so as to control the operation of the switch means 33 in a manner hereinafter set forth.

The spring slide actuator 77 has a rectangular cross-sectional configuration that permits the same to move axially in the chamber 63 of the housing part 39 while being non-rotatable relative thereto, the spring actuator 77 having a closed end wall 87 that is provided with a threaded opening 88 therethrough and carrying a threaded adjusting member 89 that has its end 90 bearing against the disc 76 so as to calibrate the range spring 74 in a manner well known in the art.

The spring actuator 77 has an extension 91 extending out of a wall 92 thereof and being provided with a cam follower surface 93, the extension 91 being adapted to project through the slot means 67 of the bracket member 59 so as to be disposed intermediate the bracket members 36 and 59 to be operated on by a cam surface 94 of the actuator means 38 which positions the slide spring actuator 77 in the chamber 63 of the housing member 39 and, therefore, determines the desired compressive setting of the compressive spring means 35 and, thereby, setting the water level that the pressure operated switch construction 30 is to provide as fully disclosed in the aforementioned Stearley et al, U.S. Pat. No. 4,081,637, and the Rhodes et al, U.S. Pat. No. 3,249,712.

While the slide spring actuator 77 can be formed of any suitable material, such as plastic material, it can be seen that the spring actuator is a one-piece structure except for the disc member 76 and adjusting member 89 thereof.

Therefore, it can be seen that the spring means 35 of the pressure operated switch construction comprises the slide spring actuator 77 and its related parts, the compression spring 74 and the spring retainer 80.

The actuator means 38 of the pressure operated switch construction 30 comprises a rotary actuator means having a longitudinal shaft means 95 that has a cylindrical end portion 96 that is adapted to snap fit into the circular opening 65 of the bracket member 59 in the manner illustrated in FIGS. 1 and 2 while a reduced cylindrical portion 97 of the shaft means 95 is adapted to be snap-fitted into the cylindrical opening at the first means of the bracket member 36 as illustrated in FIGS. 1 and 2, the first means 65 and 37 permitting the shaft means 95 to be rotatable relative thereto as fully set forth in the aforementioned Stearley et al, U.S. Pat. No. 4,081,637, and permit the cam surface 94 of the actuator means 39 to operate on the extension 91 of the slide spring actuator 77 and position the same in relation to spaces 98 between cam lobes 99 of a cam structure 100 carried by the shaft means 95.

The shaft means 95 can be formed of any suitable material, such as the plastic material as illustrated, and be a one-piece structure, if desired.

Thus, even though the shaft means 95 is snap-fit into the first means 37 and 65 of the bracket members 36 and 59, the shaft means 95 is adapted to rotate relative thereto about the longitudinal axis of the shaft means 95 and control the position of the slide actuator means 77 in the chamber 63 of the housing member 39 and, thus, the compressive force setting of the compression spring 74 opposing the upward movement of the diaphragm 45 all for a purpose well known in the art.

The electrical switch unit 33 of this invention has an outer switch blade 101 provided with contact means 102 thereon which is adapted to cooperate with either a first fixed contact means 103 or a second fixed contact means 104 respectively carried by terminal members 105 and 106 that project out of suitable opening means 107 and 108 in the housing member 39 while being secured thereto in any suitable and conventional manner, the position of the fixed contact means 103 in the housing means 31 being adjustable by a set screw means 109 threadedly carried by the housing member 39 in a manner well known in the art.

The main blade 101 of the switch unit 33 is interconnected to the center blade 84 by a rolling spring 110 which causes the main blade 101 to move against either the lower fixed contact means 103 or the upper fixed contact means 104 depending upon the position of the center blade means 84 under the control of the spring means 35 and diaphragm assembly 34 in a manner well known in the art, the main blade 101 being electrically interconnected in a manner hereinafter set forth to another terminal 111 which also projects through a suitable opening 112 in the housing member 39 and is fastened thereto in a manner hereinafter set forth so as to be positioned adjacent the terminals 105 and 106 and to be respectively electrically interconnected thereto by the operative position of the main blade 101.

The electrical switch unit 33 of this invention is uniquely formed so that the same is adapted to be assembled with the housing member 39 in a self-piloting manner and thereby does not require a riveting and assembly positioning operation as required by prior known switchblade assemblies for pressure operated switch constructions.

In particular, it is well known that the electrical switch means of a pressure operated switch construction is one of the important mechanisms thereof. In the past, the switching means generally consisted of a main blade, a center blade and a roll spring, the center blade being a stationary part which only serves as a foundation for the roll spring during operation with the roll spring and main blade being two components which cause the snap action switching. Since three separate parts are used in the prior known blade design, it is necessary to orient them properly during the assembly process to the housing means. In addition, a rivet is normally used to attach the blade assembly to the housing body while the blade assembly is being oriented so that the process serves to be costly and a prime opportunity for errors.

However, it was found according to the teachings of this invention that the electrical switch means 33 of this invention can comprise a self-contained subassembly that is generally indicated by the reference numeral 113 in FIG . 7 that can be treated as one part and therefore eliminates the need to keep track of each individual component of the switching mechanism. In addition, since the subassembly 113 of this invention is staked into the body member 39 in a manner hereinafter set forth, no connectors, such as rivets, are needed and the nature of the subassembly 113 of this invention allows it to be self-piloting so that no positional fixturing is necessary during assembly.

Figure 4:
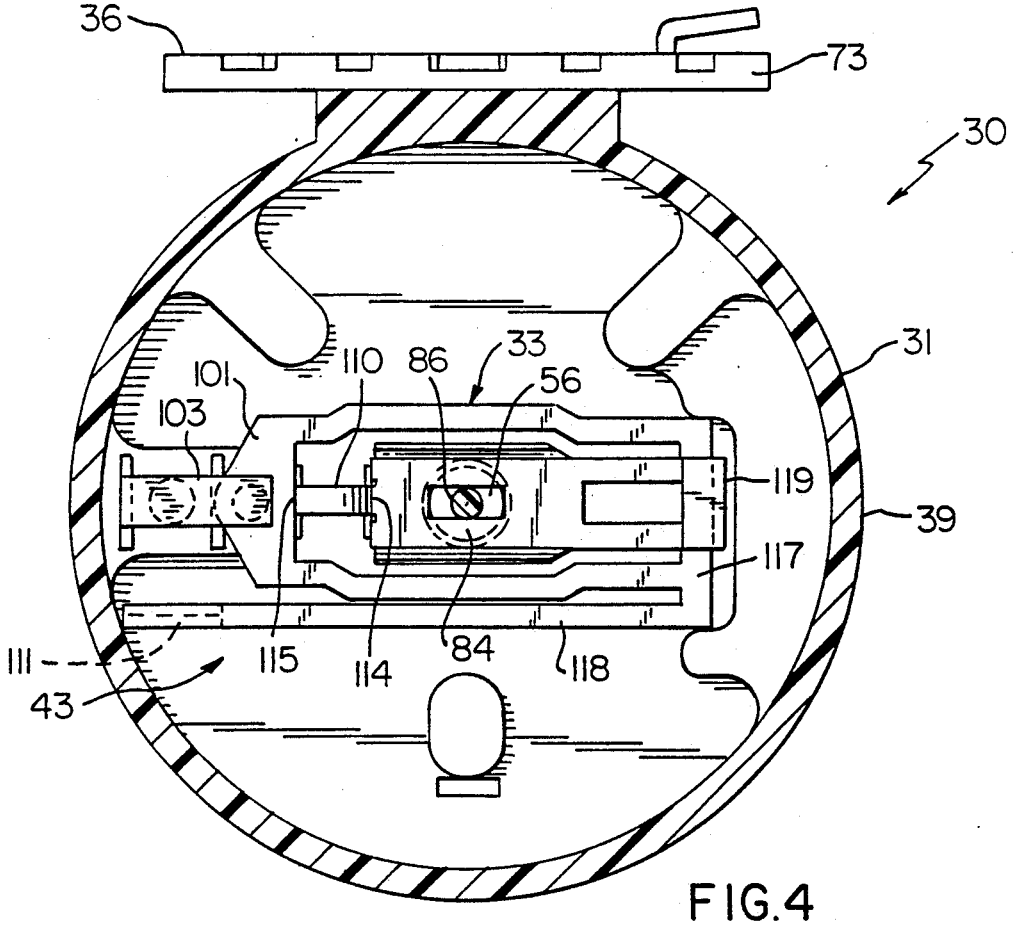
FIG. 4 is a cross-sectional view taken on line 4—4 of FIG. 3.
Figure 7:
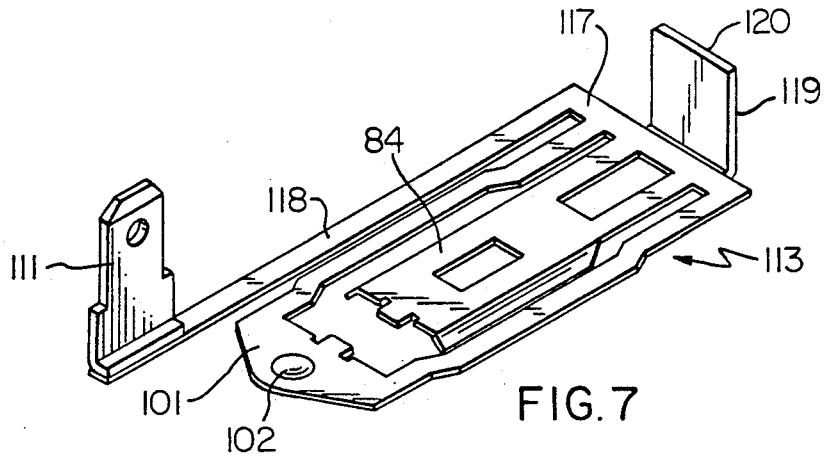
FIG. 7 is a perspective view of the electrical switch subassembly of this invention that is utilized in the pressure operated switch construction of FIGS. 1-6.

In particular, the center blade 84 and main blade 101 are formed from a one-piece metallic member that is suitably stamped and formed into the configuration illustrated in FIGS. 4 and 7 so that the roll spring 110 can have its opposed ends 114 and 115 respectively snap-fitted to the center blade 84 and main blade 101 in a conventional manner, the center blade 84 having a rectangular opening 116 passing therethrough to permit the extension 86 of the spring retainer 80 to pass therethrough as illustrated in FIG. 4 and being held between the surface 85 of the spring retainer 80 and the surface 56 of the center projection 50 of the diaphragm assembly 34 as previously set forth.

Figure 8:
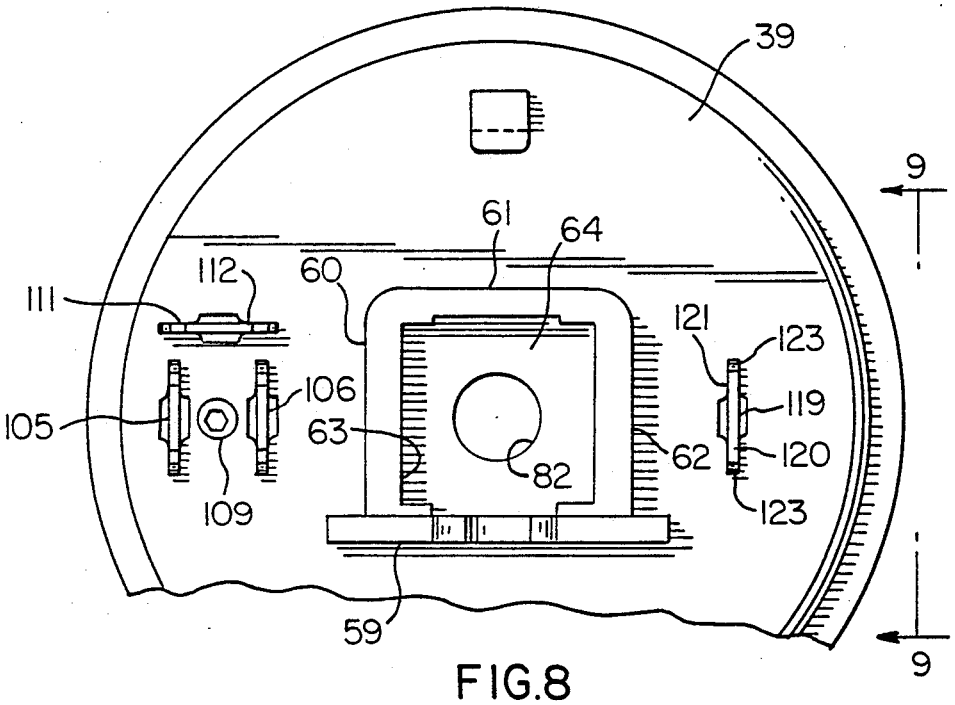
FIG. 8 is a top view of the pressure operated switch construction of FIG. 1.

The main blade 110 of the switch unit 33 has an opposed end 117 that is interconnected to an elongated part 118 to which the terminal 111 is welded so as to form part of the subassembly 113. In addition, an L-shaped metallic projection 119 is welded to the end 117 of the main blade 101 and has a leg 120 that is adapted to project through an opening 121 in the housing member 39 as illustrated in FIGS. 3, 8 and 9.

Thus, it can be seen that the electrical switch means 33 of this invention comprises a self-contained subassembly 113 that comprises the main blade 101, center blade 84, roll spring 110, terminal 111 and mounting projection means 119 all assembled together so as to be a self-contained unit that can be handled as a one-piece item during the assembly thereof with a housing means of a pressure operated switch construction.

Figure 9:
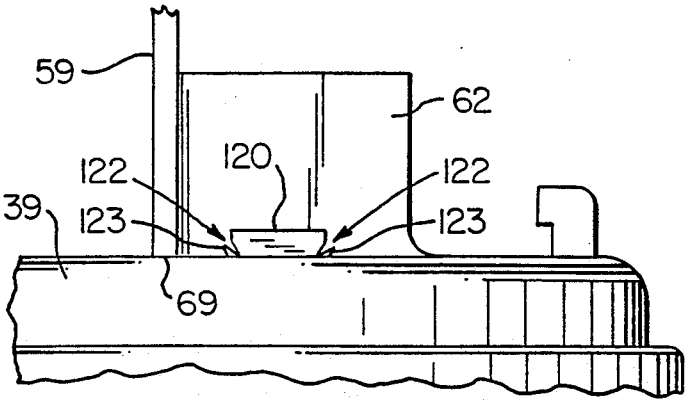
FIG. 9 is an end view of the pressure operated switch construction of FIG. 8 and is taken in the direction of the arrows 9—9 of FIG. 8.

For example, the subassembly 113 of this invention can be assembled to the housing member 39 by merely projecting the projection 120 and the terminal 111 respectively through the openings 121 and 112 which positively locate the switch means 33 in the proper position to the housing member 39 so that once the switch means 33 is in the proper position, the projection 120 and terminal 111 can be staked to the housing means 39 to fasten the same thereto such as by merely staking downwardly against the projecting portion in the areas of the arrows 122 in FIGS. 9 to form portions 123 of the respective member 120 or 111 which will bear against the external surface 32 of the housing member 39 to fasten the switchblade unit 33 thereto in the proper assembly position thereof. With the switchblade means 33 fastened in the above manner, the spring retainer 80 and diaphragm assembly 34 can then be readily assembled thereto from opposite directions so as to have the cooperating surfaces 85 and 56 sandwich the center blade 84 therebetween in the manner previously set forth.

Thus, it can be seen that the unique subassembly 113 of this invention is a much more simple and less costly mechanism than the prior known electrical switchblade means for a pressure operated switch construction or the like.

The nature of the present water level control industry has dictated many variations and duplicate parts for the pressure operated switch constructions and even though each part may serve the same purpose, nevertheless the same have been customized to one particular customer for one particular application and this has made it very difficult to automate such a diverse and complicated product line even though in order to reduce costs and improve quality, many manufacturers of other types of control devices have resorted to automated assembly. In addition, the designs for the different pressure operated switch constructions have been complicated and difficult to assemble as a great percentage of the parts involved are used as connectors which do nothing but hold the rest of the operational parts together.

For example, in the past, a pressure operated switch body or housing is generally not mounted directly to the customer's panel. Instead, a bracket is attached to the body which is designed specifically for the customer's panel and this procedure requires that the mounting bracket be screwed or riveted into the body which is both a costly and an excellent opportunity for defects to occur.

However, it was found according to the teachings of this invention that in order to minimize the part variations due to the customer requirements, a universal mounting arrangement can be provided which integrates the mounting bracket and body together into one piece and in addition this part is applicable to a large variety of mounting configurations so as to allow the use of one body for all applications regardless of mounting configurations or switch type.

Figure 10:
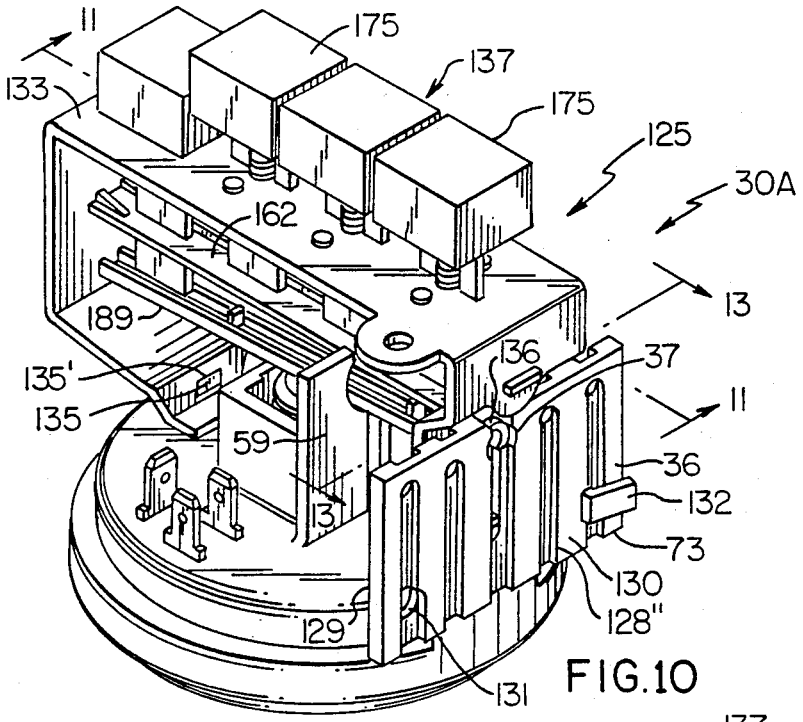
FIG. 10 is a view similar to FIG. 1 and illustrates another pressure operated switch construction of this invention.

For example, the bracket members 36 and 59 of the pressure operated switch construction 30 previously described, while respectively having the first means 37 and 65 for mounting the actuator means 38 thereto, also permit the body or housing member 39 to be utilized with a push-button actuator means that is generally indicated by the reference numeral 125 in FIG. 10 so as to form another pressure operated switch construction of this invention as generally indicated by the reference numeral 30A in FIG. 10.

Figure 18:
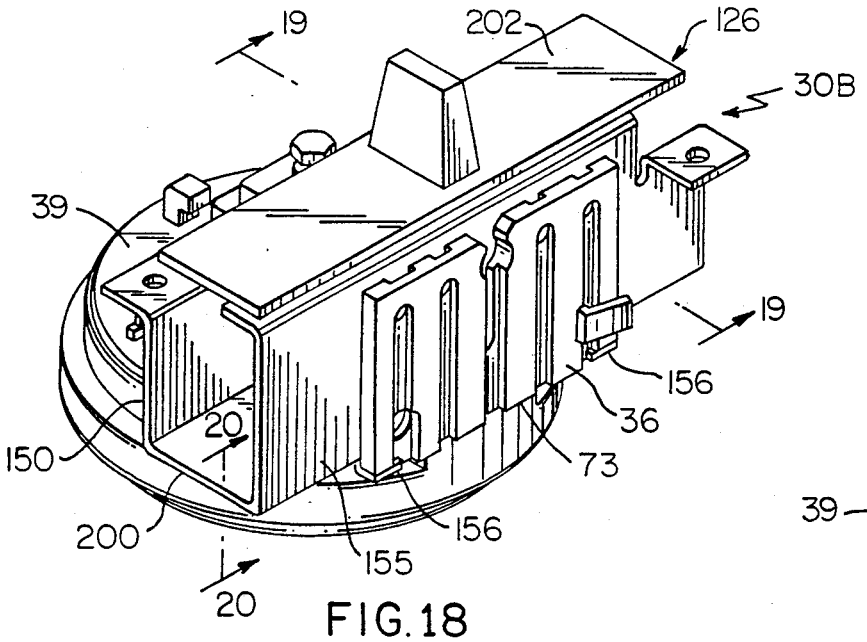
FIG. 18 is a view similar to FIG. 1 and illustrates another pressure operated switch construction of this invention.

Alternately, the bracket members 36 and 59 permit the housing body member 39 to receive a slide actuator means therebetween that is generally indicated by the reference numeral 126 in FIG. 18 so as to form another pressure operated switch construction of this invention that is generally indicated by the reference numeral 30B in FIG. 18.

Figure 24:
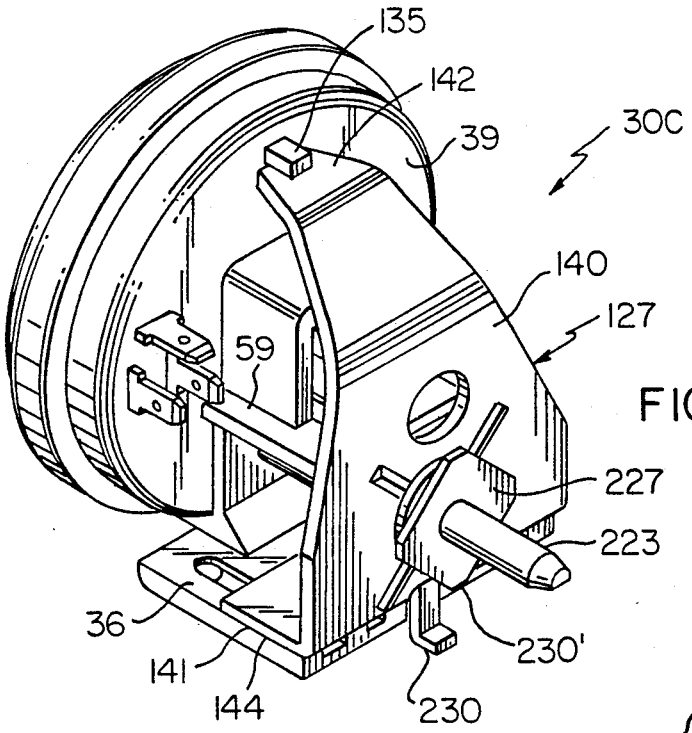
FIG. 24 is a perspective view of another pressure operated switch construction of this invention.
Figure 26:
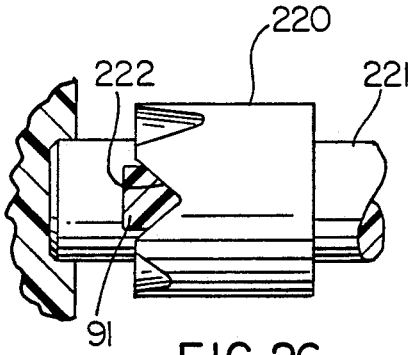
FIG. 26 a fragmentary cross-sectional view taken on line 26—26 of FIG. 25.

In addition, the bracket members 36 and 59 of the housing body member 39 of this invention permit another actuator means that is generally indicated by the reference numeral 127 in FIG. 24 to be mounted thereto so that a rotary actuator means thereof can be disposed substantially at a right angle relative to the plane of the diaphragm assembly thereof in a manner hereinafter set forth so as to provide another pressure operated switch construction of this invention that is generally indicated by the reference numeral 30C in FIG. 24.

Figure 13:
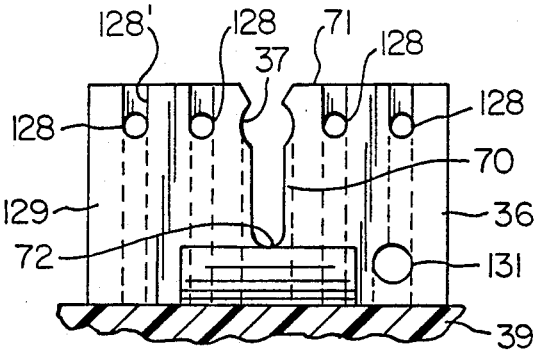
FIG. 13 is a fragmentary view of one of the bracket members of the housing means of the pressure operated switch construction of FIG. 11 and is taken generally in the direction of the arrows 13—13 of FIG. 10.

This universal mounting feature of this invention is accomplished by forming the bracket member 36 to have a plurality of aligned openings 128 formed through a rear surface 129 thereof in spaced apart relation as illustrated in FIG. 13 and have grooves 128' respectively formed in the surface 129 and leading thereto from the top surface 71 of the bracket member 36 as illustrated in FIG. 13 for snap-fit purposes as hereinafter set forth.

The other side or surface 130 of the mounting bracket member 36 can also be provided with grooves 128'' that lead from the bottom surface 73 thereof to the openings 128 for the purpose of mounting the bracket member 36 and, thus, the particular pressure operated switch construction 30, 30A or 30B, to the control panel. In addition, a large mounting opening 131 and a hook means 132 can be provided on the side 130 of the mounting bracket means 36 for such control panel mounting purpose or the like.

Figure 11:
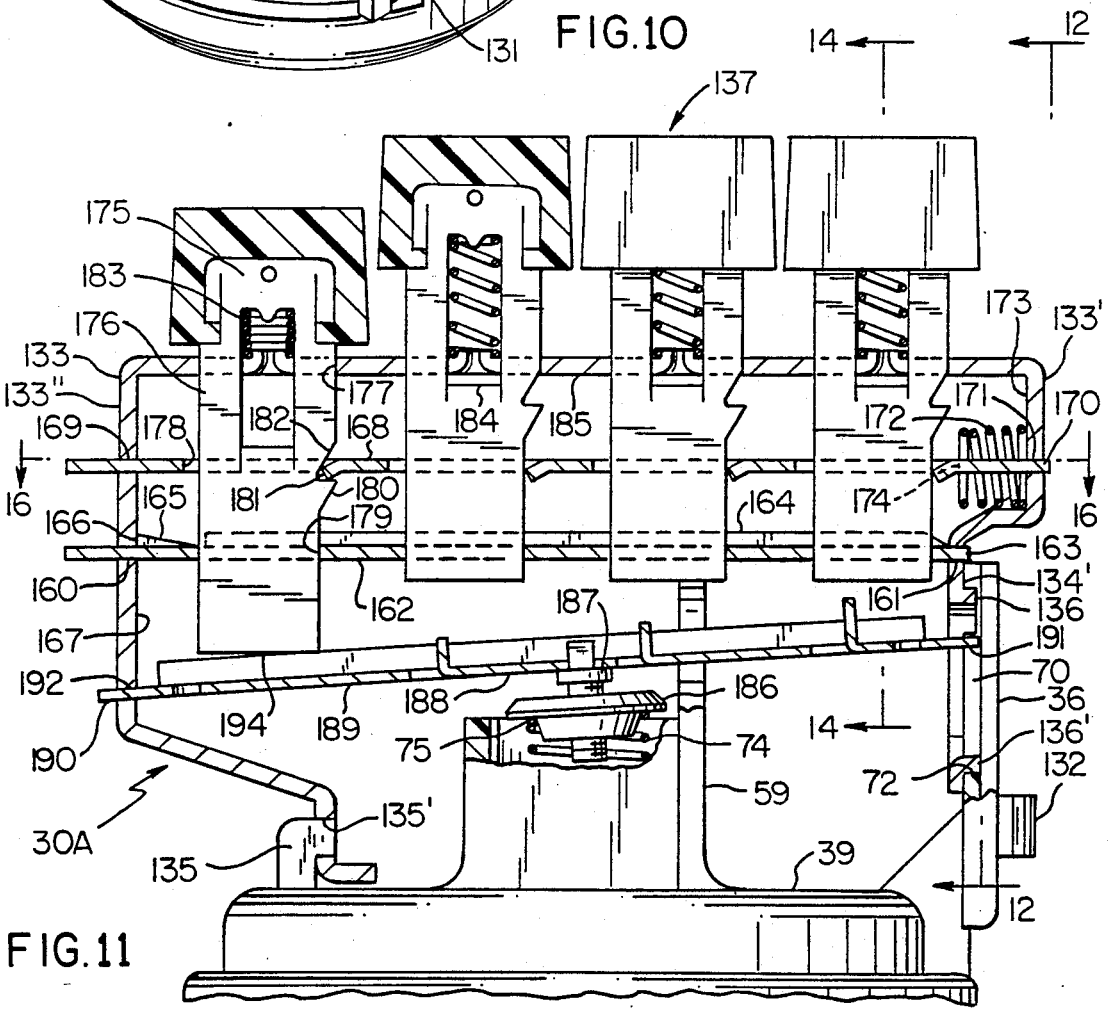
FIG. 11 is an enlarged fragmentary side view of the pressure operated switch construction of FIG. 10 with a part thereof shown in cross-section as taken on the line 11—11 of FIG. 10.
Figure 12:
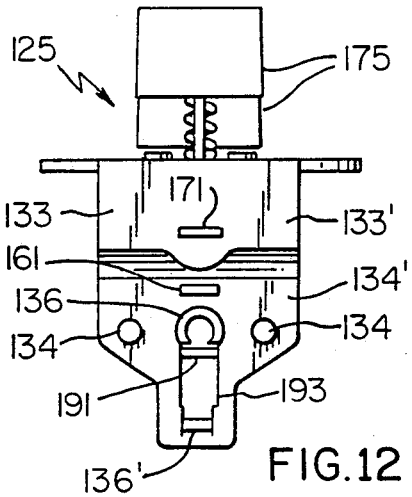
FIG. 12 is a reduced end view of the bracket structure carrying the push-button means of the pressure operated switch construction of FIG. 11 and is taken generally in the direction of the arrows 12—12 of FIG. 11.
Figure 17:
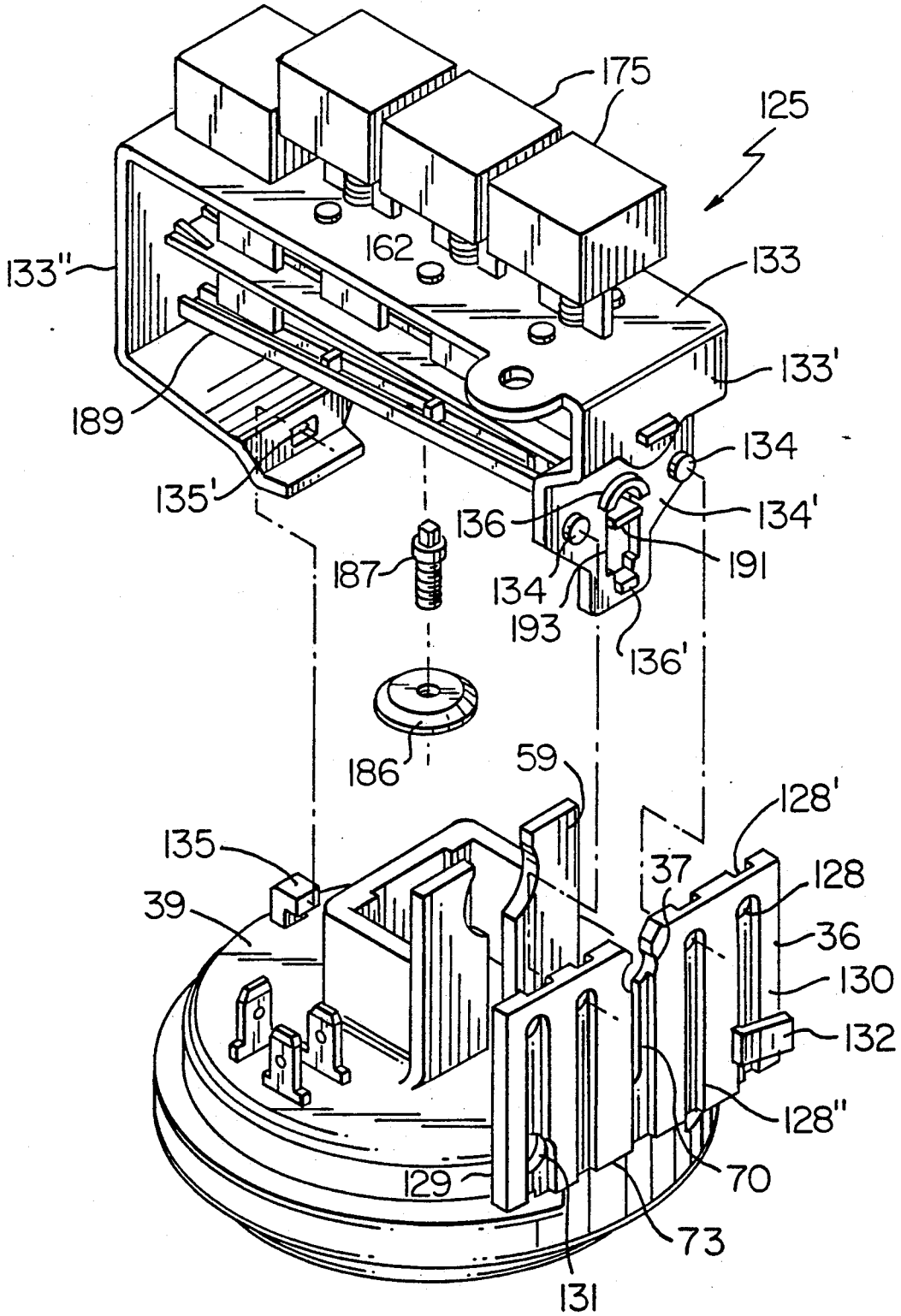
FIG. 17 is an exploded perspective view of certain parts of the pressure operated switch construction of FIG. 10.

The push-botton actuator means 125 of this invention as illustrated in FIGS. 10–17 comprises a bracket 133 formed of any suitable material, such as metallic material as illustrated, and having opposed ends 133' and 133'' with the end 133' having a pair of outwardly directed cylindrical projections 134 extending from a front surface 134' thereof in the manner illustrated in FIG. 12 so as to be inserted down through the slots 128' on the side 129 of the mounting bracket 36 to be snap-fitted into the cooperating openings 128 aligned therewith in the manner illustrated in FIG. 17 while the other end 133'' has an opening 135' receiving a hook-shaped projection 135 therein in the manner illustrated in FIG. 11, the projection 135 being an integral projection of the housing body 39 and extending outwardly from the external peripheral surface 32 thereof as illustrated. In this manner, the openings 128 of the bracket member 36 comprise a second means thereof.

The front surrace 134' of the end 133' of the bracket 133 also has a similar circular projection 136 extending outwardly therefrom and adapted to be snap-fitted into the opening of the first means 37 in the bracket member 36 as illustrated in FIG. 11, the end 133' of the bracket structure 133 having an outwardly directed tang 136' for abutting against the bottom 72 of the slot 70 of the bracket member 36 as also illustrated in FIG. 11 whereby it can be seen that the bracket 133 is easily assembled to the housing member 39 of this invention so as to be carried thereby without requiring a riveting operation.

For example, the end portion 133'' of the bracket 133 can be first hooked to the projection 135 of the housing member 39 and then the end portion 133' of the bracket structure can be pushed downwardly toward the housing body 39 to cause the projections 134 to snap-fit into their respective openings 128.

The bracket 133 includes a push-button actuator arrangement that is generally indicated by the reference numeral 137 and will be hereinafter described.

The actuator means 127 of the pressure operated switch construction 30C of this invention that is illustrated in FIGS. 24–28 comprises a bracket 140 having opposed ends 141 and 142 respectively interconnected to the bracket member 36 and hook-shaped projection 135 of the housing body member 39 of this invention in a manner similar to the bracket member 133 previously described.

In particular, it can be seen that the end 141 of the bracket 140 has a pair of outwardly directed cylindrical projections 143 on the front surface 144 thereof to be respectively snap-fitted into cooperating openings or second means 128 of the bracket member 36 after the same are slid down through the cooperating grooves 128' in a manner similar to the projections 134 on the bracket member 133 previously described. Similarly, the end 142 of the bracket 140 has an opening 145 therein that receives the hook projection 135 of the housing body member 39 therein in the manner illustrated in FIGS. 24 and 25 to firmly mount the bracket 140 thereto whereby the bracket 140 can carry any suitable actuator means for controlling the compressive spring setting of the pressure operated switch construction 30C in a manner hereinafter set forth.

Figure 20:
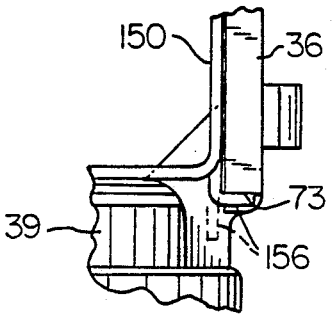
FIG. 20 is an enlarged fragmentary view taken in the direction of the arrows 20—20 of FIG. 18 and illustrates how locking tabs of the bracket structure are bent into position against the bracket member of the housing means, the unbent tab being shown in phantom lines in FIG. 20.
Figure 19:
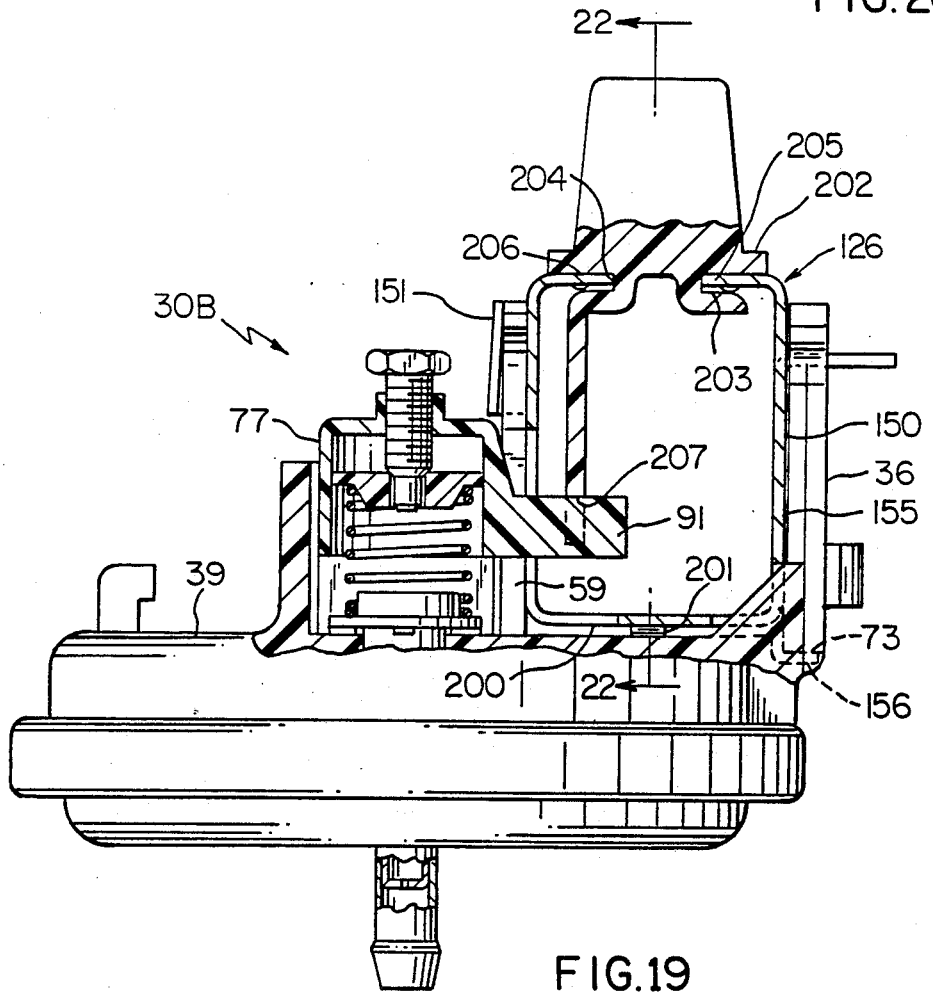
FIG. 19 is an enlarged side view of the pressure operated switch construction of FIG. 18 and has a part thereof shown in cross-section as taken on the line 19—19 of FIG. 18.
Figure 21:
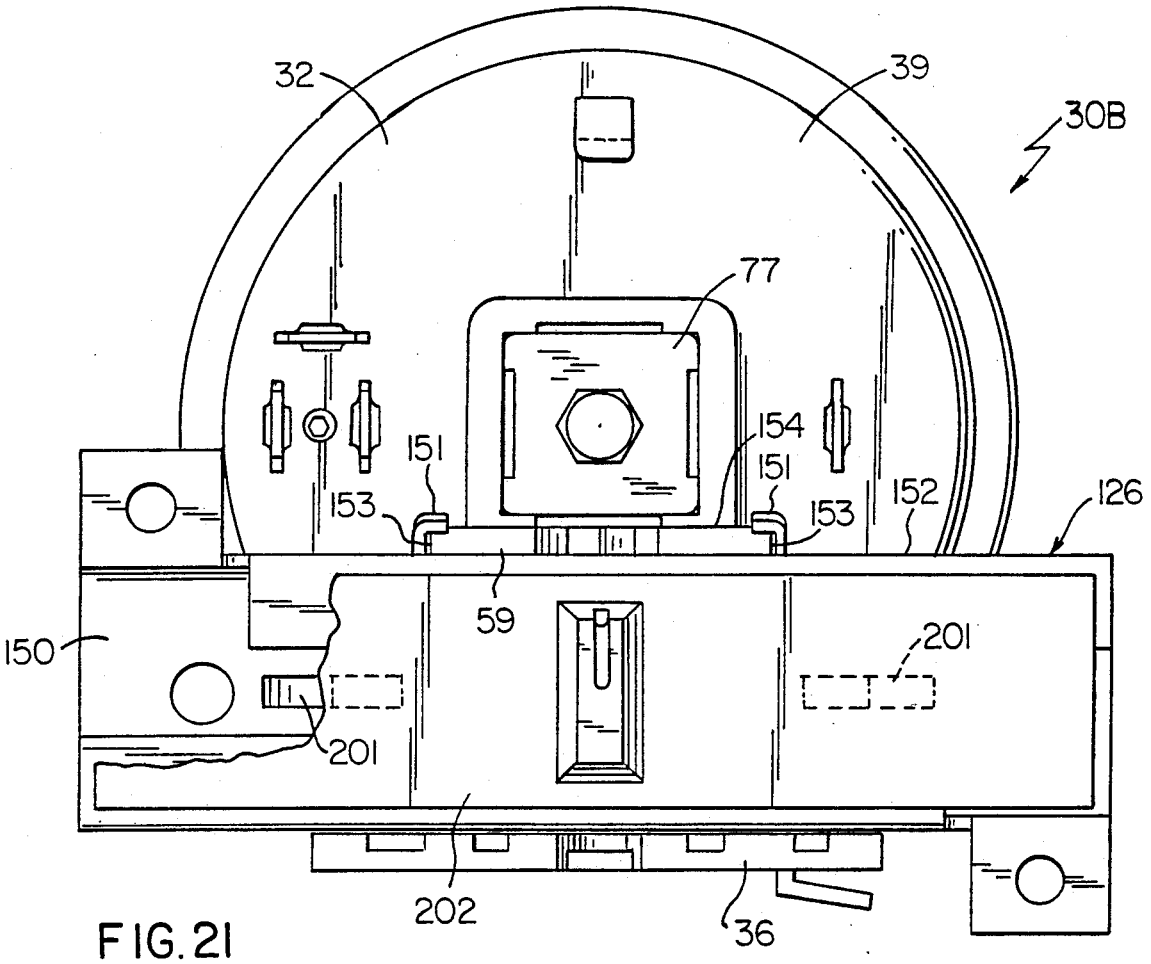
FIG. 21 is an enlarged top view of the pressure operated switch construction of FIG. 18 with part of the slide member broken away.

The slide actuator means 126 of the pressure operated switch construction 30B of FIGS. 18–23 comprises a bracket member 150 of metallic material that is substantially box-shaped and adapted to be inserted between the bracket members 36 and 59 of the housing body member 39 and be fastened thereto by having a pair of hook-shaped projections 151 that extend outwardly from one wall 152 of the bracket 150 and disposed around the side edge means 153 of the bracket member 59 to engage against the rear surface 154 thereof as illustrated in FIG. 21.

Figure 23:
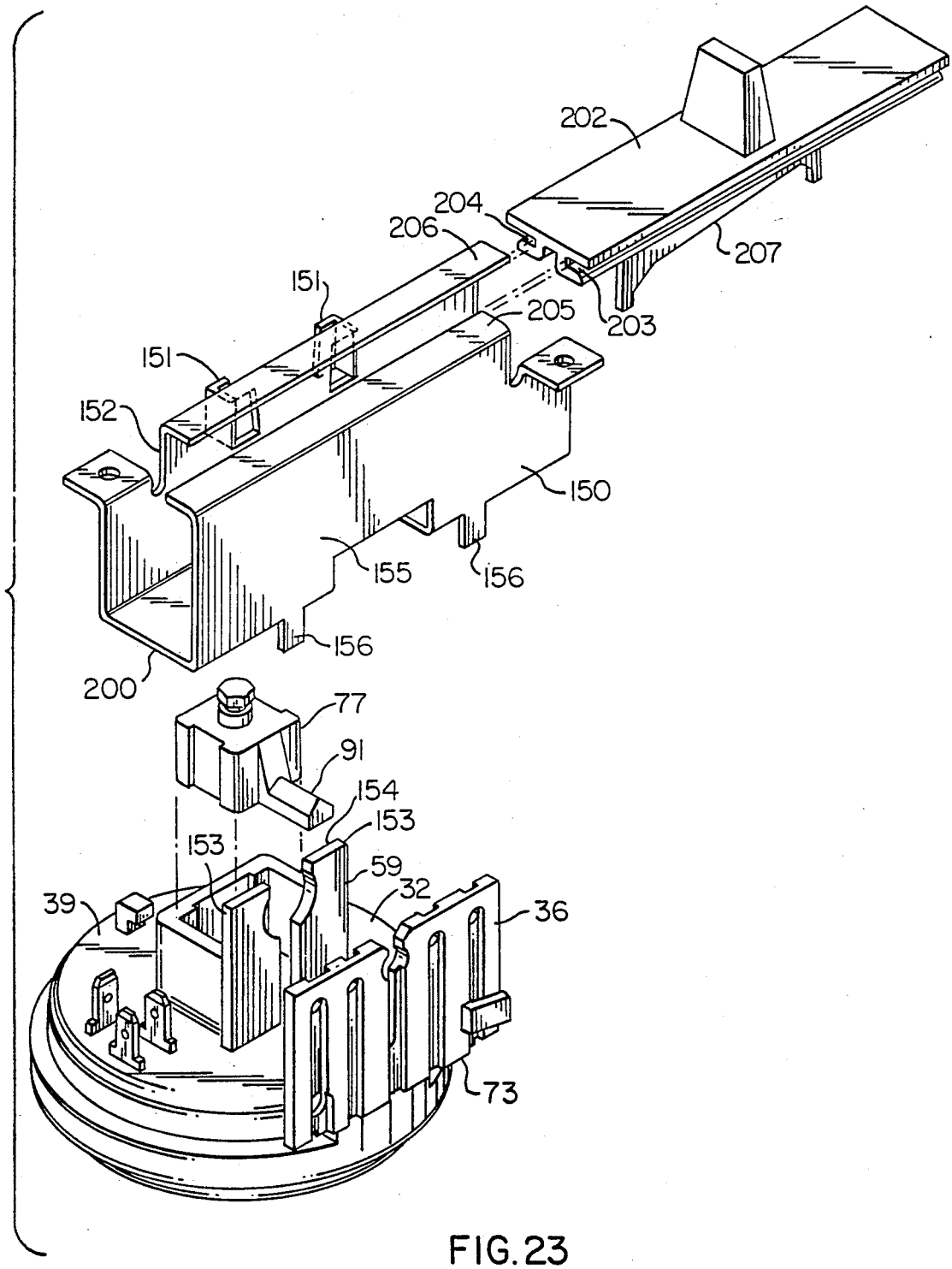
FIG. 23 is an exploded perspective view of certain parts of the pressure operated switch construction of FIG. 18.

The front wall 155 of the bracket 150 has a pair of tabs 156 extending therefrom normally in the same plane as the wall 155 as illustrated in FIG. 23 and by dotted lines in FIG. 20 but after the bracket 150 has been inserted between the bracket members 36 and 59 to its fully assembled position, the tabs 156 can be bent outwardly in the manner illustrated in FIG. 20 to engage against the under surface 73 of the bracket 36 to hold the bracket member 150 in place. The bracket 150 carries a slide actuator member in a manner hereinafter set forth.

Therefore, it can be seen that the housing member 39 of this invention through the use of the bracket members 36 and 59 thereof is adapted to receive many different types of actuator means for controlling the compressive spring setting of the particular pressure operated switch construction thereof without requiring a separate housing member for the respective different pressure operated switch constructions as in the past.

The push-button actuator assembly for pressure operated switch constructions presently requires a very labor intensive assembly process and the bracket thereof is riveted to the body thereof. The guide plate, the pressure plate and the locking plate thereof have to be inserted into the bracket before assembly and this is often a very time consuming process which is believed to be almost impossible to automate.

However, according to the teachings of this invention, the push-button actuator means 125 of the pressure operated switch construction 30A of FIGS. 10–17 of this invention has all of the components thereof inserted into the assembly without complicated assembly procedures and can be easily automated.

Figure 14:
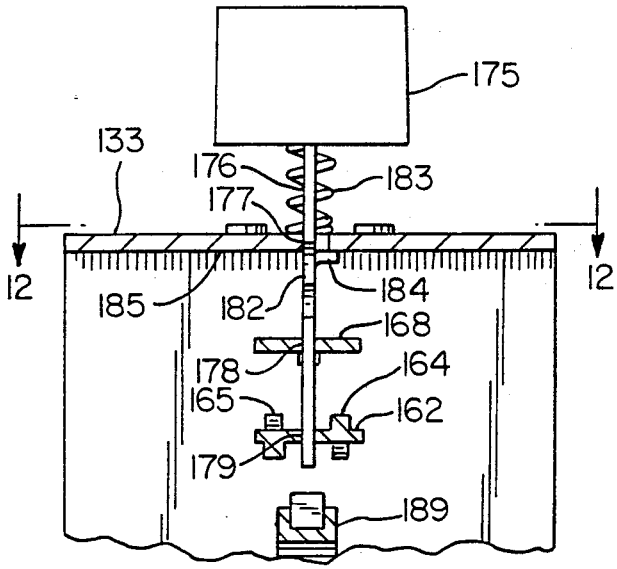
FIG. 14 is a fragmentary cross-sectional view taken on line 14—14 of 11.
Figure 15:
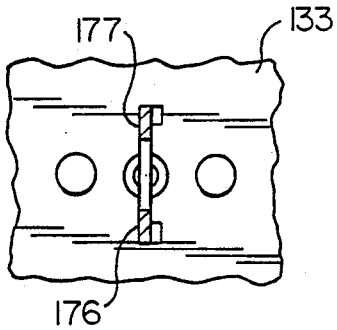
FIG. 15 is a fragmentary cross-sectional view taken on line 15—15 of FIG. 14.
Figure 16:
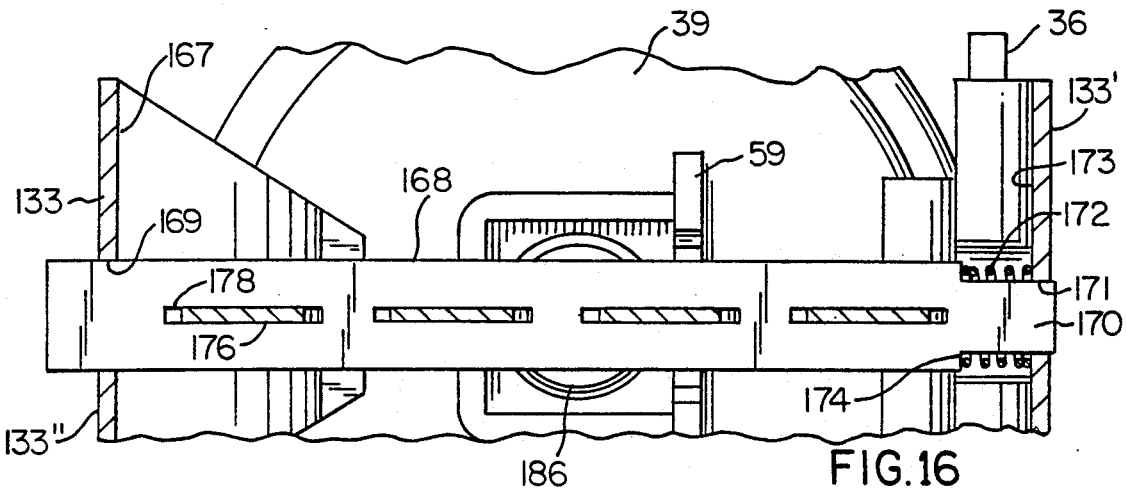
FIG. 16 is a fragmentary cross-sectional view taken on line 16—16 of FIG. 11.

In particular, the end 133'' of the bracket 133 is provided with a slot means 160 passing therethrough and the end 133' also has a slot means 161 passing therethrough in aligned relation with the slot means 160 so that a guide plate 162 can have one end 163 thereof inserted first through the slot 160 which is profiled in the manner illustrated in FIG. 14 so that projection means 164 of the guide plate means 162 can pass therethrough and then permit the end 163 to be received in the slot 161, the guide plate means 162 having opposed tab means 165 so that when the tab means 165 are forced through the slot means 160, the tab means 165 spring back in place and edges 166 thereof will engage against the inside surface 167 of the end 133'' of the bracket 133 to hold the guide plate means 162 in its assembled relation in the manner illustrated in FIG. 11.

While the guide plate means 162 can be formed of any suitable material, the same is formed in one working embodiment of this invention of plastic material so as to permit the tab means 165 to flex and spring back into place after the same have passed through the slot means 160 in the manner previously set forth.

A locking plate 168 of the actuator assembly 125 is also adapted to be inserted through a suitably profiled opening 169 in the end 133'' of the bracket 133 and then have that end 170 received in a slot means 171 in the other end 133' of the bracket 133 in the manner illustrated in FIG. 11, a compression spring 172 being disposed between an inside surface 173 of the end portion 133' and a shoulder 174 of the locking plate 168 to tend to move the locking plate 168 to the left in FIG. 11.

However, when push-button members 175 have blade parts 176 thereof inserted through suitable slot means 177 in the bracket 133 to pass through suitable slot means 178 in the locking plate 168 and suitable slot means 179 in the guide plate means 162, the blade parts 176 will prevent the locking plate 168 from moving outwardly to the left and when a hook portion 180 of one of the blade parts 176 thereof is disposed in the locking position illustrated by the left-hand locking member 175 in FIG. 11, the compression spring 172 will move a hook portion 181 of the locking plate 168 into a notch 182 of that blade member 176 to hold the same in its inserted position as illustrated in opposition to the force of a compression spring 183 normally tending to urge the blade member 176 outwardly until a bent over tab 184 of the blade member 176 abuts against the inside surface 185 of the bracket 133 in the manner illustrated by the right-hand three push-button members 175 in FIG. 11 and the push-button member 175 illustrated in FIG. 14.

Thus, when each blade 176 of the push-button members 175 is initially assembled through the respective slots 177, 178 and 179, the tab 184 thereof is bent out so as to be subsequently disposed between the locking plate 168 and the bracket 133 to hold that push-button member 175 in its assembled relation thereto.

In place of the spring slide actuator 77 previously described for the pressure operated switch construction 30, a disc-like member 186 is provided in the pressure operated switch construction 30A to have the end 75 of the compression spring 74 bear thereagainst as the member 186 has a shoulder member 187 thereof bearing against an under surface 188 of a pressure plate 189 of the actuator means 125 that has its opposed ends 190 and 191 respectively disposed in slot means 192 and 193 formed in the end portions 133'' and 133' of the bracket 133 in the manner illustrated in FIG. 11 so that the respective ends 194 of the push-button members 175 can engage against the pressure plate means 189 to set the position of the spring retainer 186 and, thus, the compressive force of the spring 74 acting to control the switch means and diaphragm assembly of the pressure operated switch construction 30A in a manner well known in the art.

Therefore, it can be seen that it is a relatively simple assembly operation of this invention to not only assemble the operating parts of the push-button actuator means 125 to the bracket 133, but also it is a relatively simple method of this invention to snap-fit the bracket 133 to the front bracket member 36 and rear hooking member 134 of the housing plate 38 so that the push-button members 175 can be utilized to set the position of the pressure plate means 189 and, thus, the compressive force of the spring 74 for water level control purposes and the like.

Of course, when it is desired to use another pushbutton 175 than the extreme left-hand push button 175 illustrated in FIG. 11, merely pushing downwardly on any of the other push buttons 175 will cause the hook end 180 thereof to cam the locking plate 168 to the right in opposition to the force of the compression spring 172 until the hook part 180 thereof begins to pass beyond the hook 181 of the pressure plate 168 which will free the previously pushed in push-button member 175 to cause the same to spring outwardly by its compression spring 183 and then once the hook 180 of that particular push-button member 175 has been pushed downwardly to beyond the hook 181 of the locking plate 168, the spring 172 will kick the locking plate 168 to the left to permit the hook 181 of the plate 168 to enter the notch 182 and hold that push-button member 175 in its pushed in condition. With such push button 175 now in its locked in position, it can be seen that the end 194 of the blade 176 thereof will reposition the pressure plate 189 to set the compressive force of the spring 74 to a different setting thereof for the operation of the pressure operated switch construction 30A in a manner well known in the art.

In the past, substantially all pressure operated switch constructions set up for a slide key configuration used a mounting bracket which is screwed into the housing body and, in order to achieve this, they must be placed into the needed position relative to the body and a screw of some type used to attach the bracket to the assembly. Although this process can be automated, it requires three operations and two unnecessary parts.

In contrast, it has been previously set forth that the slide actuator means 126 of this invention merely slips onto the housing body 39 between the bracket members 36 and 59 thereof and then the two tabs 156 are bent under the bracket member 36 to hold the bracket 150 in place.

Figure 22:
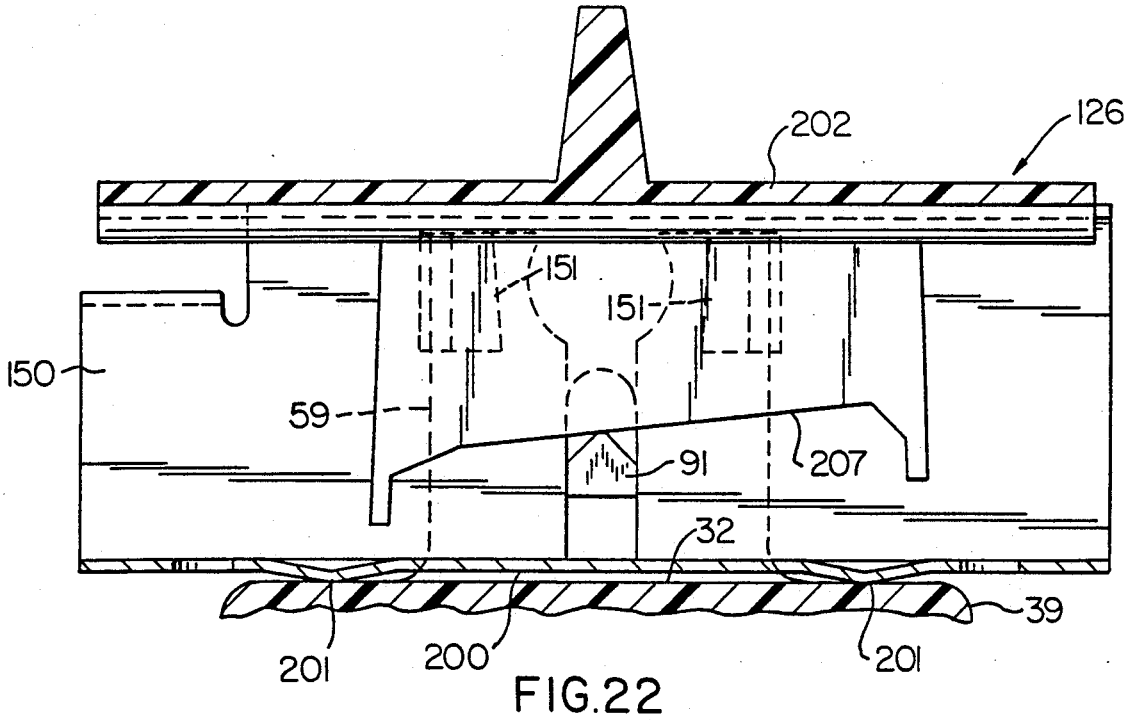
FIG. 22 is an enlarged fragmentary cross-sectional view taken on line 22—22 of FIG. 19.

However, as seen in FIG. 22, a bottom wall 200 of the bracket 150 is formed with two spring-like detent portions 201 which engage against the external surface 32 of the body 39 and tend to push the bracket member 150 outwardly. However, when the bracket 150 is initially inserted into position, the same is pushed downwardly to compress the detents 201 so that the detents 201 are in compressed relation when the tabs 156 are bent into locking position as illustrated in FIG. 20 so that the detents 201 continuously tend to push the bracket 150 outwardly whereby the bracket 150 is held tightly in place by such detent action.

It can readily be seen in FIGS. 21-23 that a slide member 202 is provided for the actuator means 126 of this invention and has opposed slots 203 and 204 for respectively receiving guide parts 205 and 206 of the bracket 150 therein when the slide member 202 is slippped onto the bracket 150 in the manner illustrated in FIG. 23, the slide member 202 having a camming surface 207 for operating on the projection 91 of the spring slide actuator 77 in a manner well known for slide operated actuator means for controlling the compressive setting of a pressure operated switch construction.

For example, see the Buckshaw et al, U.S. Pat. No. 4,800,633, for a discussion of the operation of a slide actuator means for controlling the compressive action of a range spring for a pressure operated switch construction whereby a further discussion of the operation of the pressure operated switch construction 30B of this invention is not needed.

Therefore, it can be seen that it is a relatively simple method of this invention to form the slide actuator means 126 from the bracket 150 and slide member 202 so that the bracket 150 and its associated slide member 202 can be inserted between the bracket members 36 and 59 of the housing member 39 to be interconnected thereto through the hooks 151 of the bracket 150 hooking around the rear bracket 59 as the bracket member 150 is being inserted downwardly and then the tabs 156 being hooked under the surface 73 of the front bracket member 36 to assemble the same thereto as previously set forth.

Referring now to FIGS. 24–28, the actuator means 127 of the pressure operated switch construction 30C of this invention has the bracket 140 carrying a rotatable actuator 220 which comprises a shaft means 221 provided with a camming surface 222 for operating on the projection 91 of the spring slide actuator77 to set the compressive force of the spring means 74 in the manner previously described. However, the longitudinal axis of the shaft means 221 is disposed at substantially a right angle to the plane of the diaphragm assembly of the pressure operated switch construction 30C so that the same is adapted to be mounted in the manner illustrated in FIG. 25 wherein the longitudinal axis of the shaft means 221 is disposed substantially horizontally and the plane of the diaphragm assembly is disposed substantially vertically.

Figure 25:
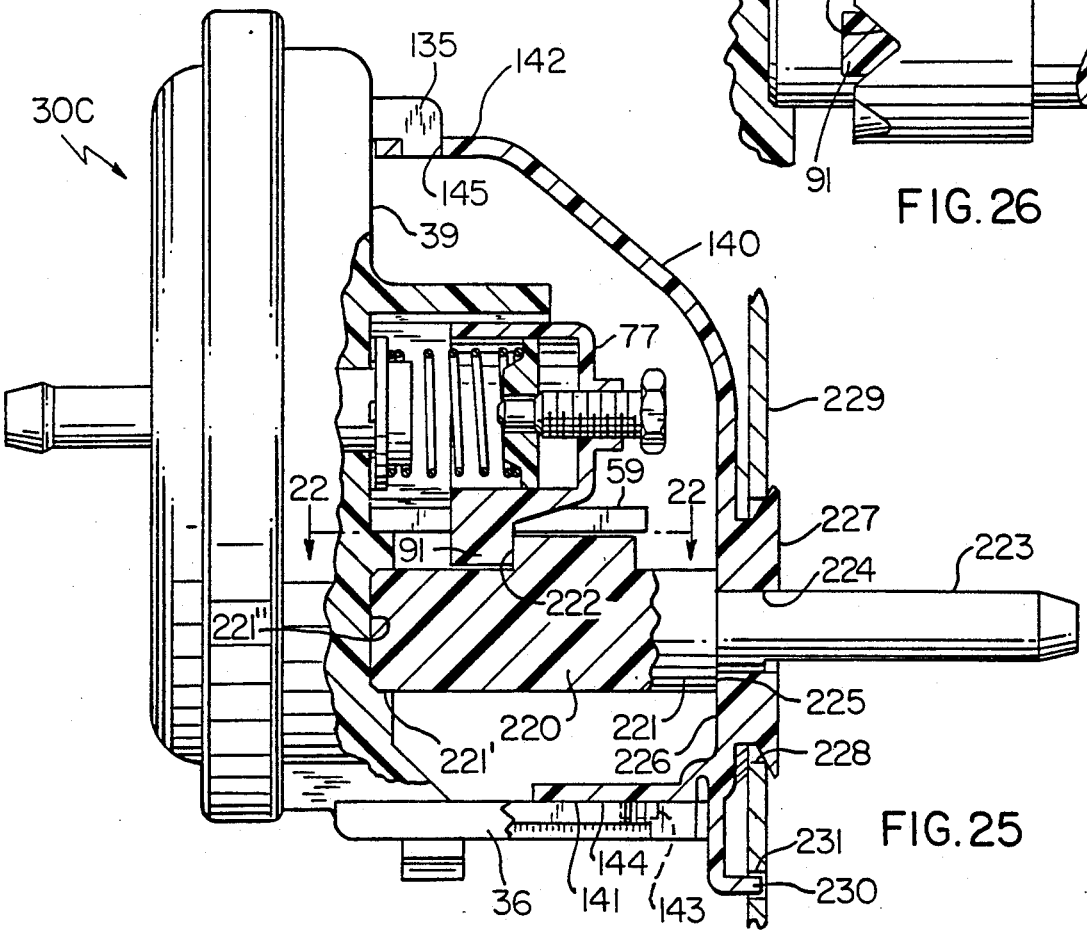
FIG. 25 is an enlarged side view of the pressure operated switch construction of FIG. 24 with a part thereof shown in cross-section as taken on the line 25—25 of FIG. 24, FIG. 25 illustrating the pressure operated switch construction of FIG. 24 mounted to a panel of an appliance.
Figure 27:
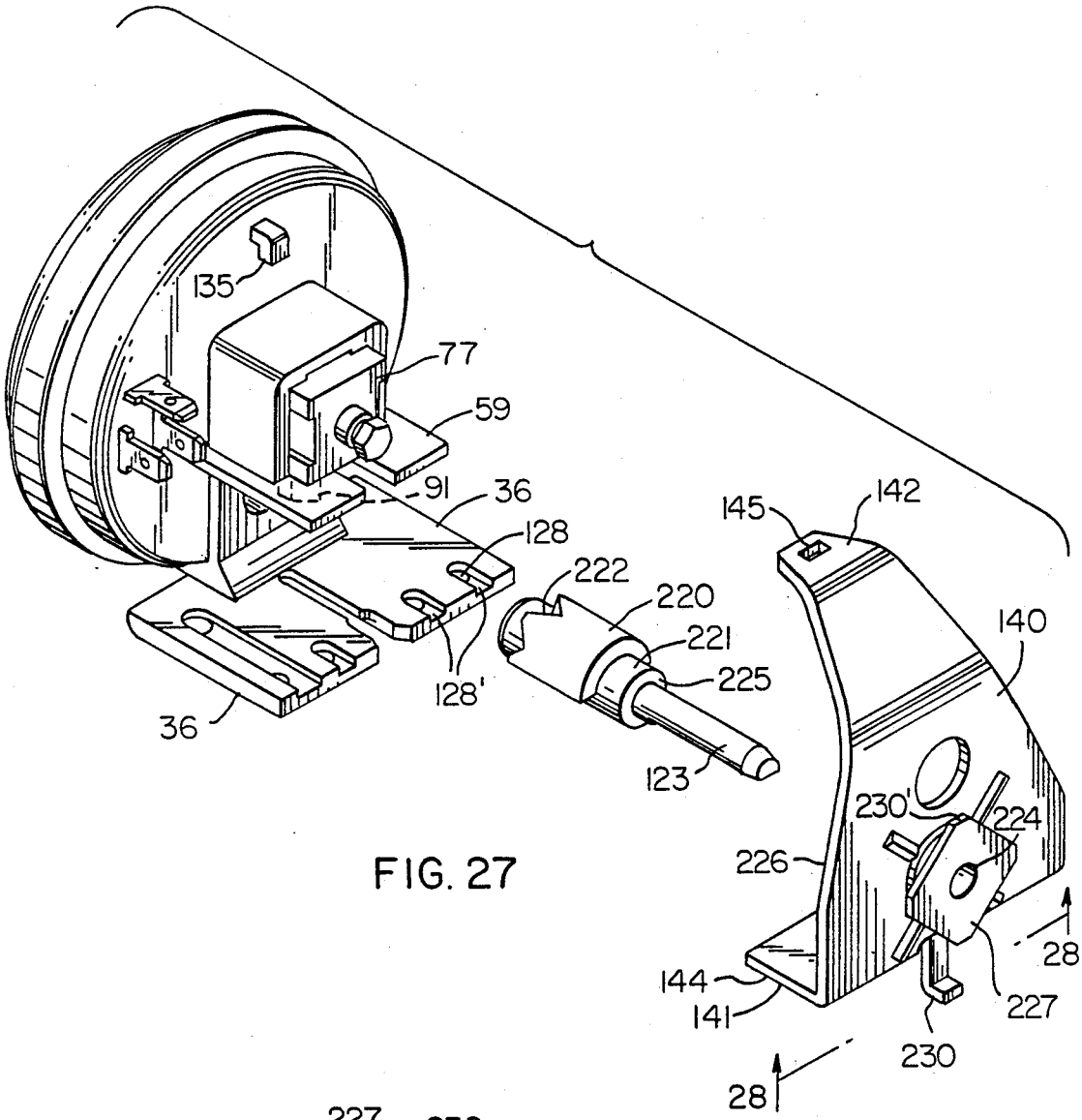
FIG. 27 is an exploded perspective view of certain parts of the pressure operated switch construction of FIG. 24.
Figure 28:
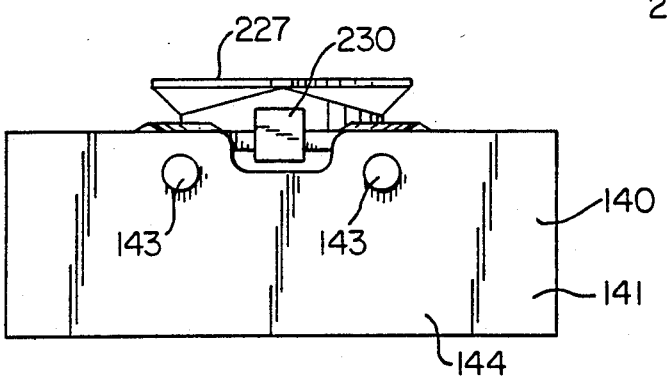
FIG. 28 is an end view of the bracket structure of FIG. 27 and is taken in the direction of the arrows 28—28 of FIG. 27.

The shaft 221 has a reduced portion 223 adapted to pass through an opening 224 of the bracket 140 and have an annular shoulder 225 engage against the interior surface 226 of the bracket 140 in the manner illustrated in FIG. 25 so as to hold the shaft means 221 in position while permitting the same to rotate relative thereto. In addition, the shaft 221 has its cylindrical end 221' rotatably received in a cooperating opening 221'' in the housing member 39 as illustrated in FIG. 25 whereby it can be seen that the shaft 21 can be readily assembled to the housing member 39 and bracket 140 to be held therebetween in its assembled relation thereto.

The bracket 140 can be formed of any suitable material and the same can be formed of plastic material as illustrated and have molded thereon a rectangular part 227 that is adapted to project through a suitable rectangular opening 228 in a control panel 229 and then be rotated to a position so that the corners 230' of the mounting structure 227 hold the pressure operated switch construction 30C in its assembled position to the control panel 229 in a manner well known in the art, the bracket 140 having a spring tang 230 for being received in an opening 231 in the panel 229 to prevent rotation of the pressure operated switch 30C unless the tang 230 is bent backwardly to free the same from the opening 231 for disassembly purposes.

Therefore, it can be seen that the actuator structure 127 for the pressure operated switch construction 30C not only is adapted to be readily assembled thereto by merely snap fitting the opposed ends 141 and 142 of the bracket 140 to the bracket member 36 and hook member 135 of the body member 39 in the manner previously set forth, but also such bracket 140 readily permits a rotary actuator means 220 to be utilized therewith and permdts the diaphragm of the construction 30C to be mounted parallel to the control panel 229 rather than perpendicularly thereto as in prior known arrangements.

Therefore, it can be seen that this invention not only provides a new pressure operated switch construction and a new method of making the same, but also this invention provides new parts for such pressure operated switch constructions and new methods of making such new parts.

For example, it is to be understood that the actuator means 125, 126 and 127 of this invention could be utilized with other types of housing bodies than the housing body 39 previously set forth. Also, it is to be understood that the housing body 39 of this invention could be utilized with other types of actuator means than the actuator means 125, 126 and 127, if desired.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a pressure operated switch construction comprising a housing means having an external surface means and carrying an electrical switch unit and a diaphragm assembly therein, and a compression spring means carried by said housing means and being interconnected to said switch unit and said diaphragm assembly to control the operation thereof in relation to the compressive setting of said springmeans, said housing means having a bracket member extending outwardly from said external surface means thereof in a flange-like manner and having first means for mounting a first movable actuator means to said housing means that is to be interconnected to said spring means to select the desired compressive setting thereof, the improvement wherein said bracket member has second means and wherein said switch construction comprises a bracket interconnected to said second means of said bracket member, and a second movable actuator means carried by said bracket and being interconnected tos aid spring means to select the desired compressive setting thereof whereby said bracket is only used with said housing means when said housing means is to carry said second movable actuator means and said bracket member is not to mount said first movable actuator means to said housing means.

2. A pressure operated switch construction as set forth in claim 1 wherein said bracket has means snap-fitted to said second means of said bracket member.

3. A pressure operated switch construction as set forth in claim 2 wherein said housing means has a hook-like projection extending from said external surface means thereof in spaced relation to said bracket member, said bracket having an opening means receiving part of said hook-like projection therein.

4. A pressure operated switch construction as set forth in claim 1 wherein said second movable actuator means carried by said bracket comprises push button means.

5. A pressure operated switch construction as set forth in claim 1 wherein said second movable actuator means carried by said bracket comprises a rotary cam means.

6. A pressure operated switch construction as set forth in claim 1 wherein said second movable actuator means carried by said bracket comprises a slide member.

7. A pressure operated swich construction as set forth in claim 1 wherein said housing means has a second bracket member extending outwardly from said external surface means thereof in spaced apart relation to the first-named bracket member, said second bracket member having second means.

8. A pressure operated switch construction as set forth in claim 7 wherein said bracket is also interconnected to said second means of said second bracket member.

9. A pressure operated switch construction as set forth in claim 8 wherein said second movable actuator means carried by said bracket comprises a slide member that is movable between said bracket members.

10. A pressure operated switch construction as set forth in claim 7 wherein said bracket members are disposed substantially parallel to each other.

11. A pressure operated switch construction as set forth in claim 7 wherein said bracket has opposed end means respectively interconnected to said bracket members.

12. A pressure operated switch construction as set forth in claim 11 wherein said opposed end means of said bracket are respectively snap-fitted to said second means of said bracket members.

13. A pressure operated switch construction as set forth in claim 1 wherein said bracket member has opening means therein that comprises said second means thereof, said bracket having projection means disposed in said opening means to interconnect said bracket to said bracket member.

14. A pressure operated switch construction as set forth in claim 13 herein said projections of said bracket are snap-fitted into said opening means of said bracket member.

15. In a pressure operated switch construction comprising a housing means having an external surface means and carrying an electrical switch unit and a diaphragm assembly therein, and a compression spring means carried by said housing means and being interconnected to said switch unit and said diaphragm assembly to control the operation thereof in relation to the compressive setting of said spring means. said housing means having a first bracket member and a second bracket member respetively extending outwardly in a flange-like manner from said external surface means thereof in spaced apart relation and respectively having first means for mounting a first movable actuator means to said housing means that is to be interconnected to said spring means to select the desired compressive setting thereof, the improvement wherein said bracket members respectively have second means and wherein said switch construction comprsies a bracket disposed betwen said bracket members and being interconnected to said second means of at least one of said bracket, membes, and movable slide actuator means carried by said bracket and being interconnected to said spring means to select the desired compressive setting thereof whereby said bracket is only used with said housing means when said housing means is to carry said movable slide actuator means and said bracket members are not to mount said first movable actuator means to said housing means.

16. A pressure operated switch construction as set forth in claim 15 wherein said bracket has tab means engaging said second means of said one bracket member to interconnect said bracket structure to that said one bracket member.

17. A pressure operated switch construction as set forth in claim 16 wherein said one bracket member has edge means spaced from said external surface means of said housing means, said tab means engaging said edge means so as to be disposed intermediate said one bracket member and said external surface means of said housing means.

18. A pressure opedge means after said bracket is disposed between said bracket members.

19. A pressure operated switch construction as set forth in claim 17 wherein said bracket has compression spring means engaging said external surface means of said housing means and thereby urging said tab means against said edge means.

20. A pressure operated switch construction as set forth in claim 16 wherein said tab means is hooked to said second means of said one bracket member.

21. A pressure operated switch construction as set forth in claim 21 wherein said one bracket member has opposed edge means, said tab means comprising two tab means respectively hooked around said opposed edge means.

22. In a pressure operated switch construction comprising a housing means having an external surface means and carrying an electrical switch unit and a diaphragm assembly therein, and a compression spring means carried by said housing means and being interconnected to said switch unit and said diaphragm assembly to control the operation thereof in relation to the compressive setting of said spring means, said housing means having a bracket member extending outwardly from said external surface means thereof in a flange-like manner and having first means for mounting a first movable actuator means to said housing means that is to be interconnected to said spring means to select the desired compressive setting thereof, the improvement wherein said bracket member has second means and wherein said switch construction comprises a bracket interconnected to said second means of said brackt member, and push button actuator means carried by said bracket and being interconnected to said spring means to select the desired compressive setting thereof whereby said bracket is only used with said housing means when said housing means is to carry said push button actuator means and said bracket member is not to mount said first movable actuator means to said housing means.

23. A pressure operated switch construction as set forth in claim 22 wherein said bracket has opening means passing therethrough, said push button actuator means comprising a plurality of push button members and a guide plate means having a plurality of slot means passing therethrough and respectively receiving parts of said push button members therein to guide the movement of said push button member, said guide plate means being snap-fitted to said bracket when initially inserted through said opening means to its assembled position with said bracket means.

24. A pressure operated switch construction as set forth in claim 23 wherein said guide plate means has opposed sides respectively having tab means extending outwardly therefrom that snap-fit with said bracket after said tab means have initially been inserted through said opening means.

25. A pressure operated switch construction as set forth in claim 22 wherein said bracket has opening means passing therethrough, said push button actuator means comprising a plurality of push button members and a locking plate means having a plurality of slot means passing therethrough and respectively receiving parts of said push button members therein, said locking plate means being initially inserted through said opening means to its assembled position with said bracket means.

26. A pressure operated switch construction as set forth in claim 25 wherein each said push button member has a tab means extending outwardly therefrom that is adapted to abut said locking plate means when the push button member is pushed in one direction a certain distance.

27. A pressure operated switch construction as set forth in claim 26 wherein said bracket has a plurality of slot means passing therethrough and respectively receiving parts of said push button members therein, said tab means being disposed intermediate said bracket and said locking palte means and abutting against said bracket when said push button members are respectively moved in the opposite direction to said one direction a certain distance.

28. In a pressure operated switch construction comprising a housing means having an external surface means and carrying an electrical switch unit and a diaphragm assembly therein, and a compression spring means carried by said housing means and being interconnected to said switch unit and said diaphragm assembly to control the operation thereof in relation to the compressive setting of said spring means, said housing means having a bracket member extending outwardly from said external surface means thereof in a flange-like manner and having first means for mounting a first movable actuator means to said housing means that is to be interconnected to said spring means to select the desired compressive setting thereof, the improvement wherein said bracket member has second means and wherein said switch construction comprises a bracket interconnected to said second means of said bracket member, and second movable actuator means carried by said bracket and being interconnected to said spring means to select the desired compressive setting thereof whereby said bracket isonly used with said housing means when said housing means is to carry said second movable actuator means and said bracket member is not to mount said first movable actuator means to said housing means, said second movable actuator means that is carried by said bracket comprising a rotatable shaft means having a longitudinal axis that is disposed substantially at a right angle to said diaphragm assembly.

* * * * *

UNITED STATES PATENT AND TRADEMARK OFFICE

CERTIFICATE OF CORRECTION

PATENT NO. : 5,109,144

DATED : April 28, 1992

INVENTOR(S) : William J. Kaigler

It is certified that error appears in the above—identified patent and that said Letters Patent is hereby corrected as shown below:

Column 19, line 20, cancel the comma ",";
line 21, cancel "membes" and insert --members--;
line 41, cancel "opedge" and insert--operated switch construction as set forth in claim 17 wherein said tab means is bent into engagement with said edge --.

Signed and Sealed this

Thirteenth Day of July, 1993

*Attest:*

Michael K. Kirk

MICHAEL K. KIRK

*Attesting Officer*

*Acting Commissioner of Patents and Trademarks*